US006544085B1

(12) United States Patent
Ménard et al.

(10) Patent No.: US 6,544,085 B1
(45) Date of Patent: Apr. 8, 2003

(54) WATERCRAFT HAVING A CLOSED COOLANT CIRCULATING SYSTEM WITH A HEAT EXCHANGER THAT CONSTITUTES AN EXTERIOR SURFACE OF THE HULL

(75) Inventors: Éric Ménard, Rock Forest (CA); Michel Bourret, Drummondville (CA); Gilbert Lefrançois, Canton Magog (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/691,129

(22) Filed: Oct. 19, 2000

Related U.S. Application Data

(60) Provisional application No. 60/160,819, filed on Oct. 21, 1999.

(51) Int. Cl.[7] ..... B63H 21/10; B60H 3/00

(52) U.S. Cl. ..... 440/88; 165/44

(58) Field of Search ..... 440/88; 165/41, 165/44; 60/221, 222

(56) References Cited

U.S. PATENT DOCUMENTS

| | | | | | |
|---|---|---|---|---|---|
| 468,050 | A | * | 2/1892 | Trabold | 122/208 |
| 2,382,218 | A | * | 8/1945 | Fernstrum | 440/88 |
| 3,240,179 | A | * | 3/1966 | Ranst | 440/88 |
| 3,292,373 | A | * | 12/1966 | Tado | 60/221 |
| 3,650,310 | A | * | 3/1972 | Childress | 165/44 |
| 3,841,396 | A | * | 10/1974 | Knaebel et al. | 165/44 |
| 4,557,319 | A | * | 12/1985 | Arnold | 440/88 |
| 4,747,450 | A | * | 5/1988 | Ikegame et al. | 165/168 |
| 5,408,965 | A | * | 4/1995 | Fulton et al. | 123/196 AB |
| 5,507,673 | A | * | 4/1996 | Boggia | 440/46 |
| 5,732,665 | A | | 3/1998 | Morrison | |
| 5,846,102 | A | | 12/1998 | Nitta et al. | |
| 6,015,320 | A | | 1/2000 | Nanami | |

OTHER PUBLICATIONS

1997 Ski–Doo Parts Catalog, Published 1997 (3 pages).

* cited by examiner

*Primary Examiner*—D. Glenn Dayoan
*Assistant Examiner*—Andy Wright
(74) *Attorney, Agent, or Firm*—Pillsbury Winthrop LLP

(57) ABSTRACT

A closed coolant circulating system for a watercraft, for traveling along a surface of a body of water, containing a supply of coolant that is caused to flow through the coolant circulating system. The watercraft comprises a hull and an engine. The watercraft also comprises a heat exchanger formed from heat conductive material and having a fluid path defined therein with an inlet port and an outlet port. The heat exchanger has a heat exchanging exterior surface and is mounted to the hull such that the heat exchanging exterior surface constitutes a portion of the exterior surface of the hull that is normally disposed below the surface of the body of water. The heat conductive material of the heat exchanger allows the heat absorbed by the coolant to dissipate from the coolant to the body of water via the heat exchanging exterior surface as the coolant flows through the fluid path.

109 Claims, 19 Drawing Sheets

WATERCRAFT HAVING A CLOSED COOLANT CIRCULATING SYSTEM WITH A HEAT EXCHANGER THAT CONSTITUTES AN EXTERIOR SURFACE OF THE HULL

The present application claims priority to U.S. Provisional Application of Menard et al., Ser. No. 60/160,819, filed Oct. 21, 1999, the entirety of which is hereby incorporated into the present application by reference.

FIELD OF THE INVENTION

The present invention relates a watercraft having a closed loop coolant circulating system with at least one heat exchanger constituting an exterior surface of the hull.

BACKGROUND OF THE INVENTION

Many small, recreational watercraft, such as personal watercraft (PWC), are powered by water-cooled two-stroke internal combustion engines. These engines use open-loop cooling systems that draw water through a water intake from the body of water through which the watercraft is traveling, circulate that water through the water jacket of the engine to absorb heat from the engine and then expel the water through an outlet back to the environment. Typically, the water inlet for such an open-loop system is located between the impeller and the venturi of the watercraft propulsion system so that a small volume of pressurized water is diverted to the engine water jacket and then to the outlet without the need for a dedicated water pump.

This open-loop cooling system performs adequately for many types of engines, including many two-stroke engines, which are not especially sensitive to temperature for optimal operating conditions. Nevertheless, an open-loop cooling system has certain drawbacks.

First, with an open-loop system, debris or contaminants from the environment (such as leaves, aquatic plants, mud and even small insects and marine animals) can enter the open system, thereby partially or completely obstructing passage(s) and/or reducing the efficiency of the cooling system.

Second, when operating the watercraft in salt water, the cooling system's pipes and water jacket manifold become susceptible to corrosion due to the presence of salt within the water flowing through the cooling system. To prevent such corrosion from occurring, it is necessary to use corrosive-resistant materials and/or surface treatments on the cooling system components. This increases the cost of the components and complicates design and manufacture. Further, even when using such materials or coated components, it is advisable to flush the seawater from the system after use to minimize its damaging effects. This is also time-consuming and inconvenient.

Furthermore, with an open-loop system the temperature of the ambient water introduced into the system from the environment can change considerably, depending on the season and/or location, by as much as 40° F. or more. This makes it more difficult to regulate the desired cooling effect of the system and keep the engine in the desired operating temperature range.

U.S. Pat. No. 5,507,673 to Boggia (the '673 patent) discloses a watercraft having an internal combustion engine and a closed coolant circulating system. Because the coolant circulating system is closed, the problems discussed above with respect to open-loop cooling systems are obviated. However, the coolant circulating systems of the '673 patent does not provide sufficient heat exchanging surface to properly dissipate engine heat from the coolant because the coolant is passed only through the tubular members that constitute the grate covering the impeller tunnel intake opening. The theory behind this construction is that the coolant inside the grating tubular members will dissipate heat from the coolant therein to the water flowing through the grate into the impeller tunnel. However, in practice this is an impractical construction because the grate's tubular members fail to provide a sufficient amount of surface area to allow the coolant therein to effectively dissipate heat.

Consequently, there exists a need in the art for a watercraft with an improved closed coolant circulating system that provides sufficient heat exchanging surface area to allow heat from the engine to be dissipated to ambient water in an effective manner without the drawbacks associated with the system.

SUMMARY OF THE INVENTION

To meet the above-described need, the present invention provides a watercraft for travelling along a surface of a body of water comprising a hull having an exterior surface; an engine constructed and arranged to generate power, the engine also generating heat during the generation of power; and a propulsion system operatively connected to the engine and being constructed and arranged to propel the watercraft along the surface of the body of water using the power generated by the engine. The watercraft of the present invention further comprises a closed coolant circulating system containing a supply of coolant that is caused to flow through a fluid path during operation of the engine. The circulating system has an engine heat absorbing portion through which the coolant flows. The engine heat absorbing portion is positioned with respect to the engine such that at least a portion of the heat generated by the engine is absorbed by the heat absorbing portion and the coolant flowing therethrough.

A heat exchanger is formed from a heat conductive material and has a heat exchanging fluid path defined therein with an inlet port and an outlet port. The heat exchanger has a heat exchanging exterior surface and is mounted to the hull such that the heat exchanging exterior surface constitutes a portion of the exterior surface of the hull that is normally disposed below the surface of the body of water when the watercraft is in an upright position. The inlet and outlet ports are respectively communicated to the engine heat absorbing portion such that the heat exchanging fluid path constitutes a portion of the coolant circulating system with the coolant flowing into the heat exchanging fluid path from the heat absorbing portion via the inlet port and from the fluid path back to the heat absorbing portion via the outlet port. The heat conductive material of the heat exchanger allows the heat absorbed from the engine by the coolant to dissipate from the coolant to the body of water via the heat exchanging exterior surface as the coolant flows through the fluid path.

With such a closed coolant circulating system, there is no opportunity for debris or contaminants from the environment to enter the system and blocking passages, thereby reducing the efficiency of the closed coolant circulating system.

In addition, because the coolant circulating system is closed, water from the body of water on which the watercraft is travelling is not allowed to enter the cooling system. Therefore, it is not necessary to take the special steps discussed above to prevent corrosion from occurring within the coolant circulating system due to the watercraft's use in salt water. Nor does the coolant circulating system need to be flushed when the watercraft is operated in salt water.

A particularly advantageous feature of the present invention is that the heat exchanger is mounted to the hull such that the heat exchanging exterior surface thereof constitutes a portion of the exterior surface of the hull that is normally disposed below the surface of the body of water when the watercraft is in an upright position. As a result of this construction, the heat exchanger can be provided with a relatively large heat exchanging exterior surface, which contacts the body of water. Also, because the heat exchanging surface constitutes a portion of the hull's exterior surface, the heat exchanger takes advantage of a large amount of available surface area in the watercraft that already exists to provide the heat exchanging surface. Consequently, heat exchanging can be achieved in a more effective and efficient manner than in the construction disclosed in the '673 patent discussed above.

In one preferred aspect of the invention, the engine is a four-stroke internal combustion engine. The introduction of more stringent emissions standards has led watercraft designers to look for four-stroke engines that run cleaner than two-stroke engines. In a two-stroke engine, lubricating oil is usually either mixed with the fuel or injected into the intake tract for lubricating the pistons, rings, cylinder walls, bearings, etc. This oil entering the combustion chamber results in a greater amount of incompletely combusted hydrocarbons in the exhaust of the typical two-stroke engine. On the other hand, in a four-stroke engine, oil is not mixed with fuel to lubricate the walls of the cylinders. Instead, oil is routed through passages in the piston and connecting rod assembly for lubricating the sides of the piston head. Therefore, less oil reaches the combustion chamber and hydrocarbon emissions are reduced.

The operation of many four-stroke engines is, however, more sensitive to temperature and requires a reliable cooling system capable of maintaining the engine operating temperature within an optimal, narrow range. An open-loop cooling system that simply circulates water from the body of water through which the watercraft travels is inadequate for such temperature-sensitive four-stroke engines because, as discussed above, the temperature of the water drawn into the open loop cooling system can vary greatly due to environmental conditions. By using the closed-loop coolant circulating system of the present invention in combination with a four-stroke engine, the problems associated with variations in ambient water conditions can be minimized.

In another preferred aspect of the present invention, the heat exchanger has a plate-like configuration and is a ride plate mounted at an underside stem portion of the hull along a centerline thereof. In this aspect, the heat exchanger and the ride plate define an impeller tunnel having a rearward discharge opening at the stem and a forward intake opening spaced forwardly of the discharge opening. The propulsion system includes an impeller assembly mounted to the ride plate/heat exchanger within the tunnel. The impeller assembly has an impeller with a plurality of blades, which is connected to the engine so as to rotate under power from the engine such that the impeller draws water out from the tunnel through the discharge port is a pressurized stream to propel the watercraft.

This preferred aspect is particularly advantageous because it takes advantage of an existing structure, the ride plate, which is normally made from heat conductive material. Specifically, the ride plate of a watercraft is typically made from metal so that it is rugged enough to withstand impacts with submerged objects during high speed operation of the watercraft. Modifying the ride plate so that it also functions as a heat exchanger advantageously allows the present invention to be implemented without modifying the hull itself so as to incorporate the heat exchanger on the exterior of the hull itself.

Other objects, features, and advantages of the present invention will become apparent from the following detailed description, the accompanying drawings, and the appended claims.

DETAILED DESCRIPTION OF THE INVENTION

Figure 1:
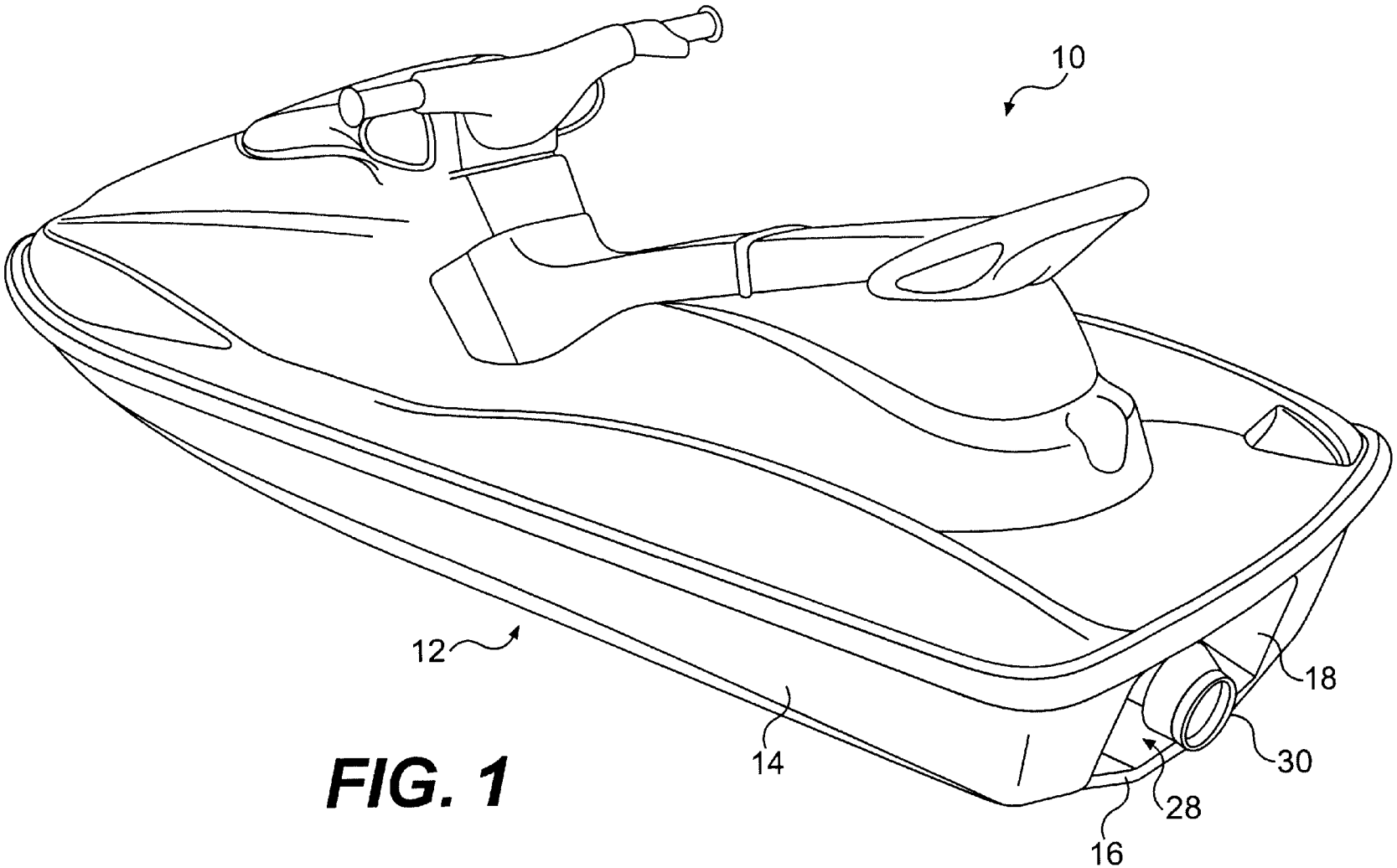
FIG. 1 is a perspective view of a personal watercraft of the present invention.

FIG. 1 shows a personal watercraft (PWC), generally indicated at 10, for traveling along a surface of a body of water. The PWC 10 includes a hull, generally shown at 12, for buoyantly supporting the PWC 10 on the surface of the body of water. The hull 12 is typically molded from fiberglass material and lined with buoyant foam material and comprises an exterior surface 14 configured with a V-shaped bow to reduce drag resistance between the surface of the body of water and the hull 12. The PWC 10 further includes a ride plate 16 that, in cooperation with the hull 12, forms an impeller tunnel 18, as will be described below.

Figure 2:
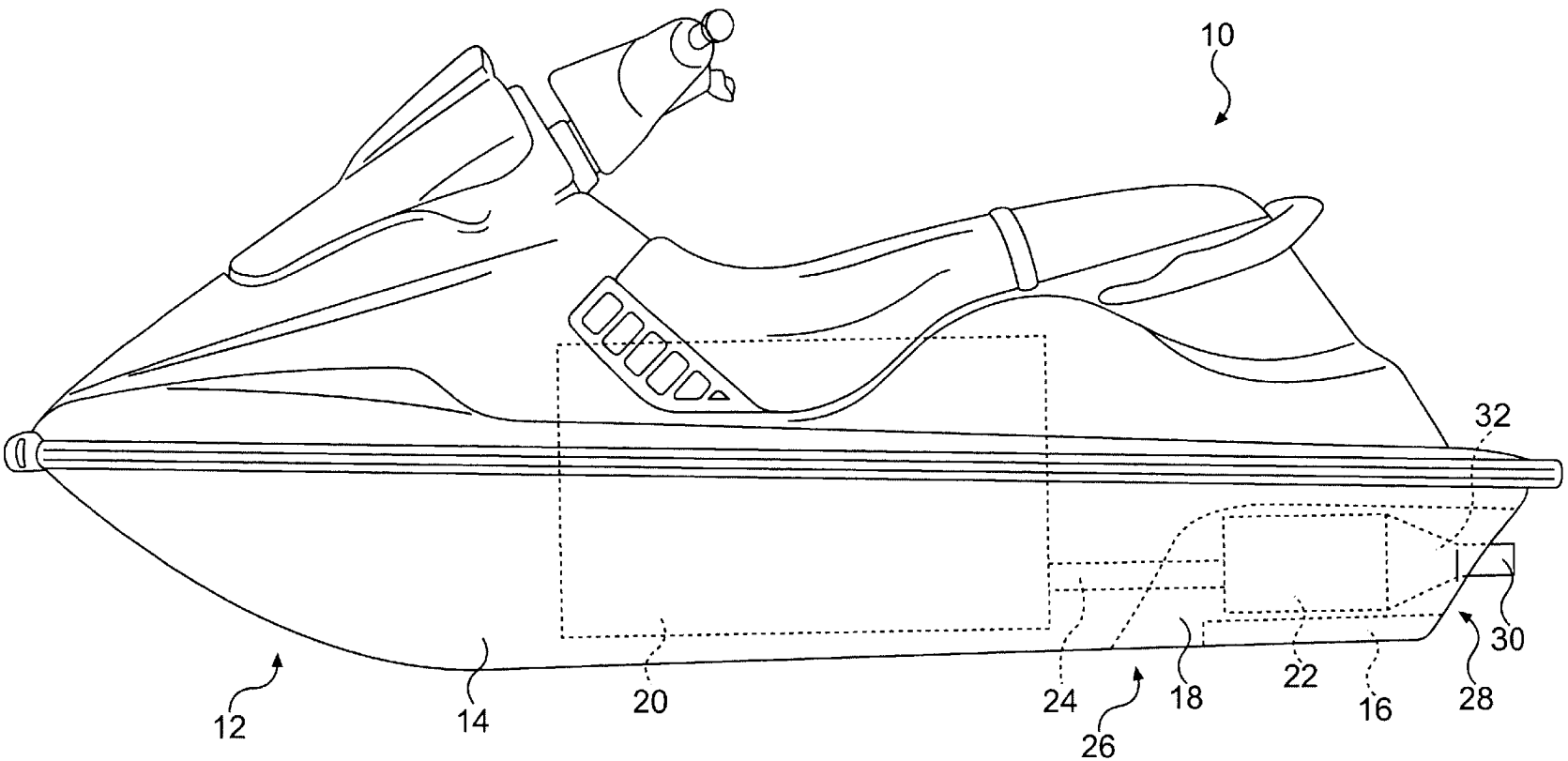
FIG. 2 is a side view of the personal watercraft illustrated in FIG. 1, with the engine, driveshaft, propulsion system and ride plate shown in phantom.

As shown in FIG. 2, the PWC 10 preferably has an internal combustion engine, shown schematically at 20, to provide power generation thereto, which engine 20 is operatively connected to a propulsion system 22, preferably by a metallic driveshaft 24 (propulsion system 22 and driveshaft 24 are shown schematically in FIG. 2). The propulsion system 22, which in the illustrated embodiment is in the form of an impeller assembly, is positioned within the impeller tunnel 18 and rigidly mounted to the hull 12. Alternatively, it is contemplated that any suitable propulsion system, such as an outboard mounted propeller, may be used in place of the impeller assembly. A forward intake opening 26 of the impeller tunnel 18 allows the propulsion system 22 to intake water from the body of water, while a rearward discharge opening 28 in the impeller tunnel 18 allows water discharged through a steering nozzle 30 of the propulsion system 22 to be directed in an aft direction away from the PWC 10, thus propelling the PWC 10 in a forward direction. The steering nozzle 30 may be pivoted in a starboard or port direction by an operator to allow steering of the PWC 10, as is well known in the art. Furthermore, the steering nozzle 30 may be capable of trim adjustment, as well. Trim adjustment is well known in the art and allows a rider to adjust the pitch of the watercraft with respect to the surface of the body of water and thereby manipulate the contact area between the hull and the surface of the body of water. A venturi 32 is positioned between the impeller assembly and the steering nozzle 30 to further pressurize the water being discharged through the nozzle 30.

The internal combustion engine 20 affords a relatively high power-to-weight ratio and, perhaps more important in PWC 10, a high power-to-space ratio. However, the internal combustion engine 20 produces a significant amount of heat. A closed loop cooling system is used to remove excess heat from the engine 20.

Figure 3:
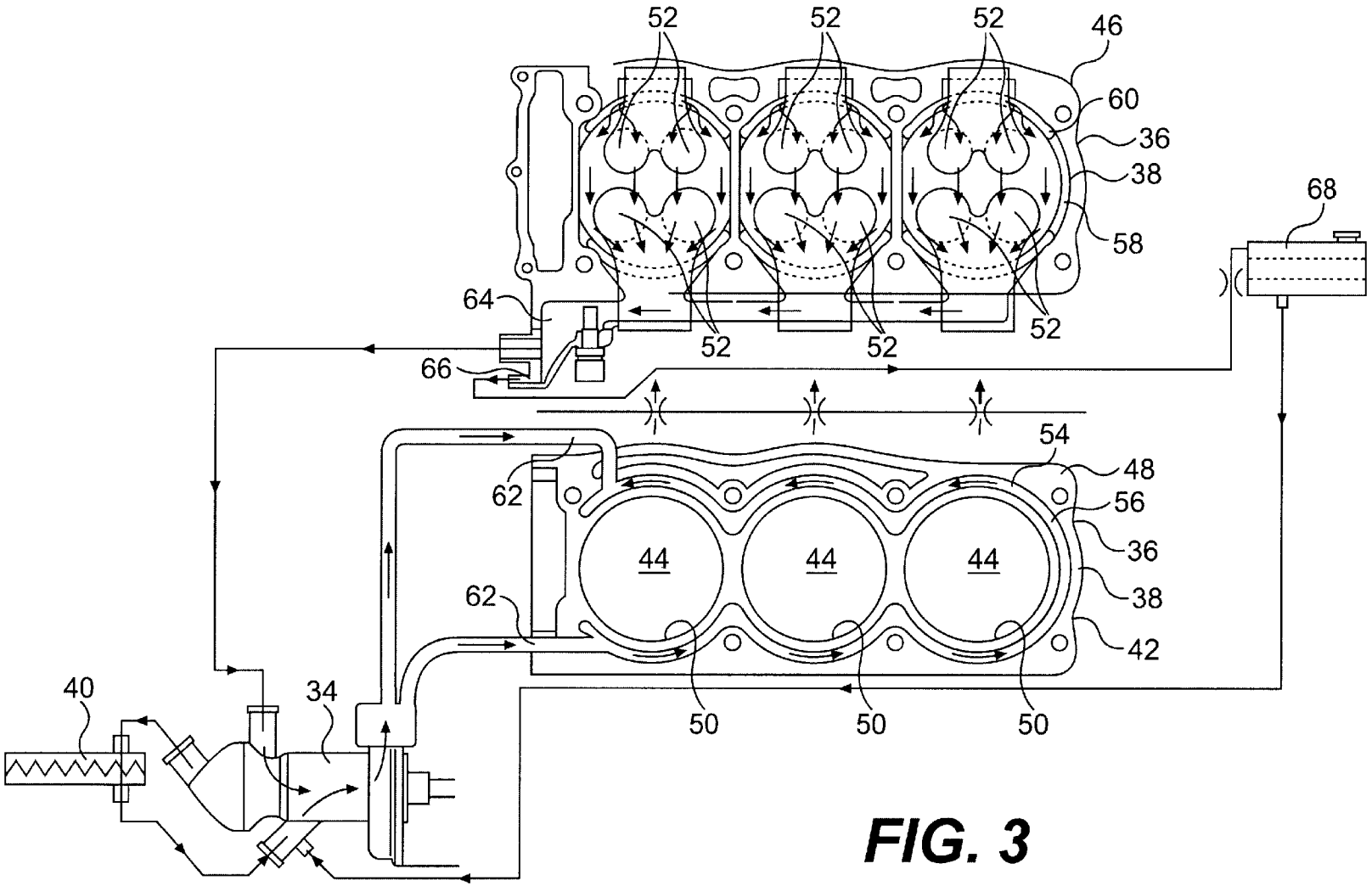
FIG. 3 is a schematic view of the closed loop cooling system circuit.

A cooling system circuit, for the closed-loop cooling system of the present invention, is shown schematically in FIG. 3 (also shown in FIG. 15) and comprises a water pump 34 to circulate a coolant (preferably a mixture of glycol and water, or any other suitable liquid coolant), an engine heat absorbing portion 36, preferably a coolant jacket 38 effectively surrounding the periphery of the engine 20, and a heat exchanger 40. The coolant is pumped through the coolant jacket 38 by the water pump 34 to absorb heat from the engine 20. Coolant exiting the coolant jacket 38 then returns to the water pump 34 and is directed via flexible hoses or rigid piping through the heat exchanger 40 where the heat is dissipated into the body of water on which the PWC 10 is floating. The coolant cooled by the heat exchanger 40 is then returned to the water pump 34 via flexible hoses or rigid piping and circulated back through coolant jacket 38 to repeat the cycle.

As shown in FIG. 3, engine 20 includes an engine block portion 42 having cylinder bores 44. An engine cylinder head portion 46 (shown separate from engine block portion 42 for display of the coolant jacket 38) is mounted to an upper surface 48 of engine block portion 42. A combustion chamber is formed in each cylinder bore 44, defined by respective cylinder walls 50 provided by the cylinder bore 44, a lower surface (not shown) of the cylinder head portion 46 and an upper surface of a piston (not shown) disposed within each cylinder bore 44. Cylinder head portion 46 includes exhaust and intake valves 52, which allow air from an external environment to enter each combustion chamber and exhaust fumes to exit therefrom at intervals determined by engine speed.

The coolant jacket 38 is configured to partially surround each combustion chamber to remove heat therefrom produced by the ignition of a fuel, (introduced into each combustion chamber by an associated fuel injector) and mechanical friction between moving components within the engine 20. It is noted that engine 20 may also be normally aspirated (as opposed to the use of fuel injectors described above), wherein a carburetor (not shown) will form a fuel/air mixture, which is introduced to the combustion chambers via the intake valves 52. A coolant opening 54 within the engine block portion 42 defined by the coolant jacket 38 provides a coolant path 56 within the engine 20 (indicated by arrows within the engine block portion 42) that partially surrounds the periphery of each cylinder bore 44. The coolant opening 54 extends upwardly along the length of the cylinder bores 44 where a communicating opening 58 within the cylinder head portion 46 defined by the coolant jacket 38 provides an additional coolant path 60 therethrough (indicated by arrows within the cylinder head portion 46). Inlet ports 62 in the engine block portion 42 allows the coolant to enter the coolant jacket 38. The coolant then flows through the coolant path 56 around the cylinder bores 44. The coolant then enters the communicating opening 58 where it flows through the cylinder head portion 46 and exits from an outlet port 64 in the cylinder head portion 46.

A coolant thermostat (not shown) allows coolant to bypass the heat exchanger and circulate through the coolant jacket 38 until the coolant temperature reaches a predetermined relatively high temperature. At this point the coolant thermostat allows an increasing amount of coolant to flow through the heat exchanger as the coolant temperature increases. The closed loop system, as above described, maintains a relatively constant engine temperature by recirculating the relatively cooler coolant through the coolant jacket 38 and directing the relatively warmer coolant through the heat exchanger 32 to be cooled therein. A bypass 66 allows coolant of a predetermined relatively high temperature to dispense into a coolant expansion tank 68 to prevent a high-pressure build-up within the cooling system due to the thermal expansion of the coolant.

Heat is dissipated from the heat exchanger 40 due to a temperature variance between heat conductive material of the heat exchanger 40 and the body of water. The abundance of relatively cooler water provided by the body of water allows a great deal of heat to be absorbed by the body of water from the heat exchanger 40. Furthermore, the process of convection, wherein warmer, relatively lower density, water molecules proximate the heat exchanger 40 are displaced by cooler, relatively higher density, water molecules, ensures that the heat exchanger 40 may effectively cool the engine 20 even when the PWC 10 is not in motion across the surface of the body of water.

Figure 4:
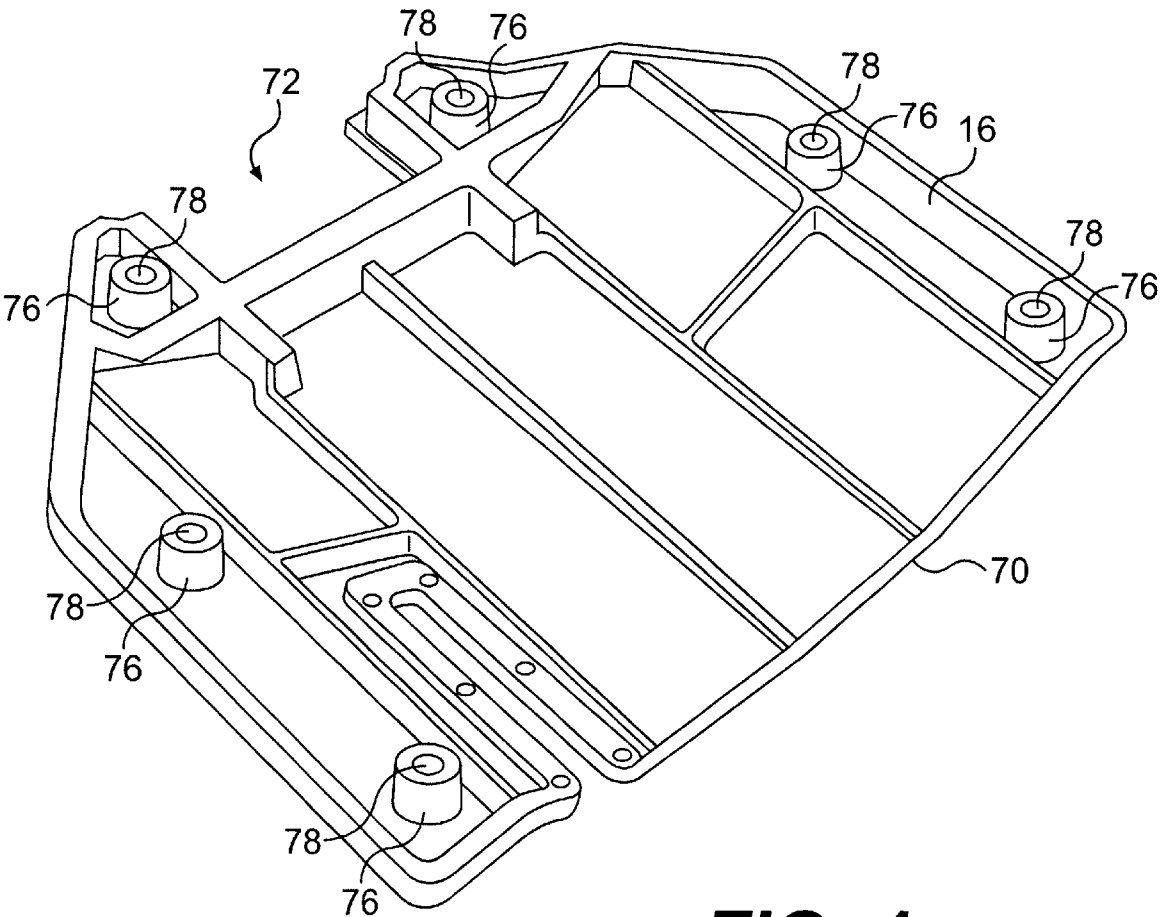
FIG. 4 is a perspective view of a typical ride plate for a personal watercraft.
Figure 5:
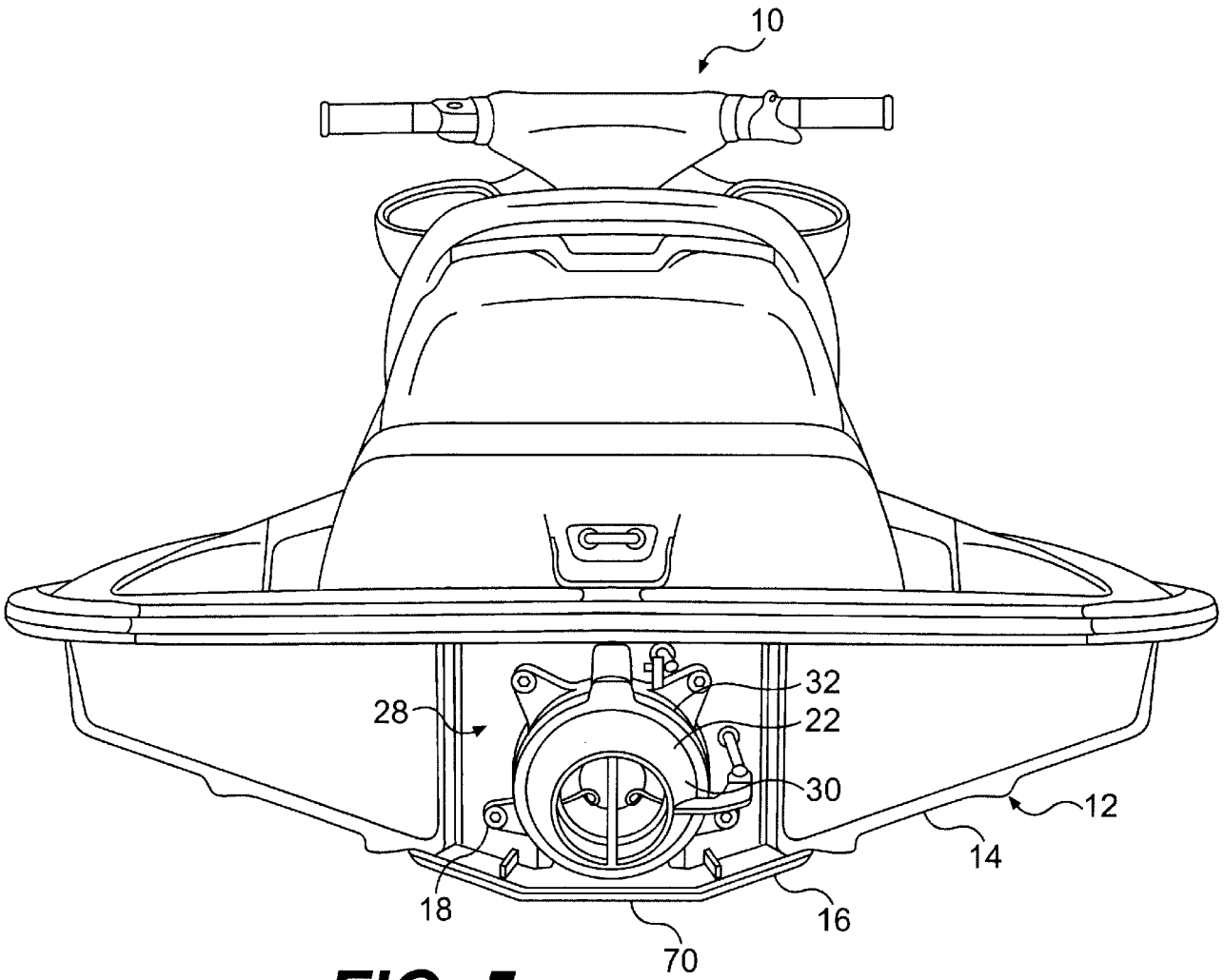
FIG. 5 is a rear view of the personal watercraft illustrated in FIG. 1.
Figure 6A:
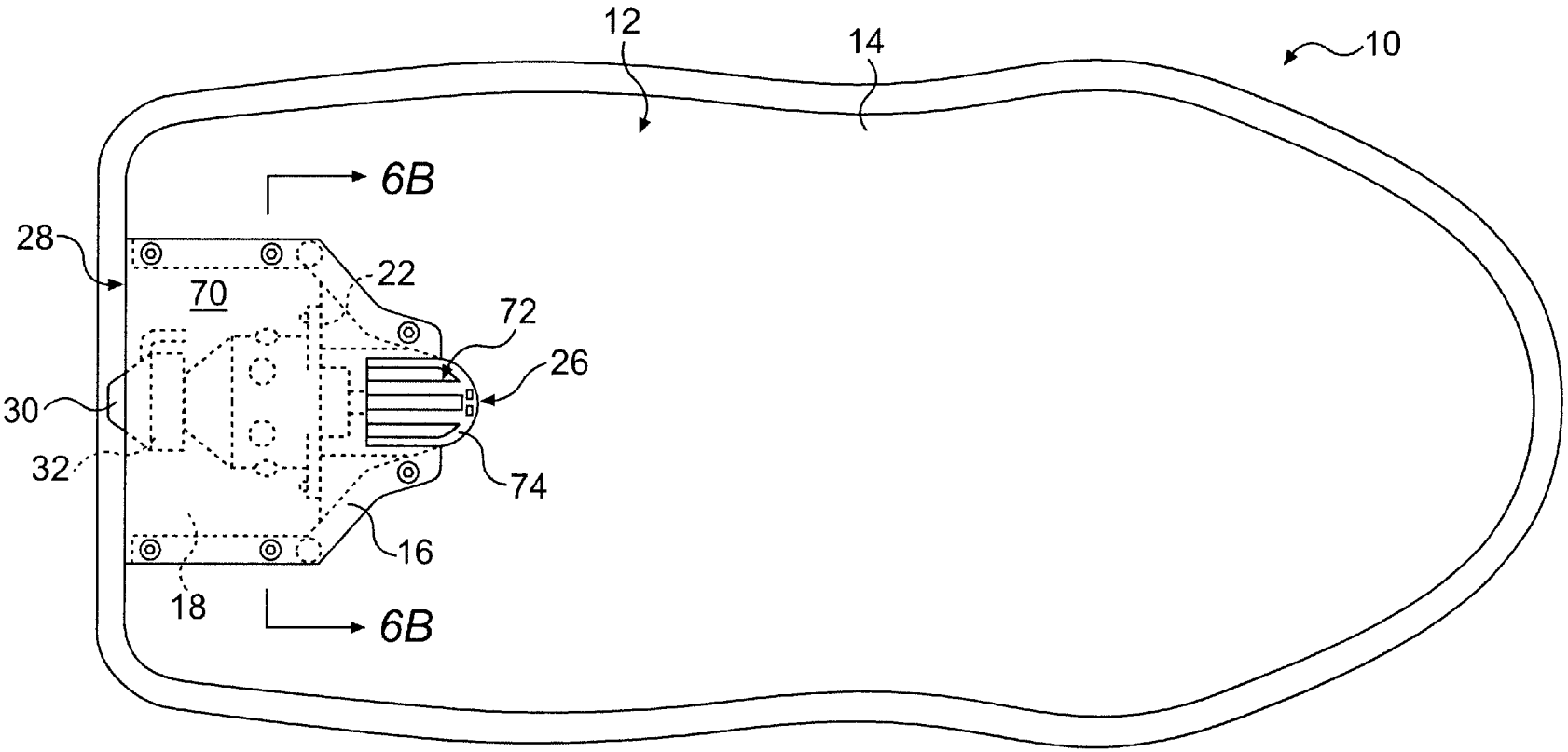
FIG. 6A is a bottom view of the personal watercraft illustrated in FIG. 1.

The ride plate 16, shown in FIG. 4, is formed from a rigid material, preferably a metal such as aluminum, steel, or magnesium. The ride plate 16 is positioned at the aft end of the PWC 10, such that an exterior downwardly facing surface 70 of the ride plate 16 is flush with and forms a portion of the exterior surface 14 of the hull 12. As described above and shown in FIGS. 2 and 5, the ride plate 14 mounts to the hull 12 to form the impeller tunnel 18. Specifically, a partial intake opening 72 (FIG. 4) is provided on the forward edge of the ride plate 16. This partial opening 72 cooperates with a corresponding partial intake opening 74 in the hull 12 to form the forward intake opening 26 (FIG. 6A) through which water is brought into the propulsion system 22. An aft edge of the ride plate 16 forms a partial periphery of the rearward discharge opening 28. The remainder of the periphery of the rearward discharge opening 28 is formed by respective aft edges of the hull 12 associated with the impeller tunnel 18. Water brought in through the forward intake opening 26 is pressurized by the propulsion system 22 and then discharged under pressure by the steering nozzle 30 through the rearward discharge opening 28.

Figure 6B:
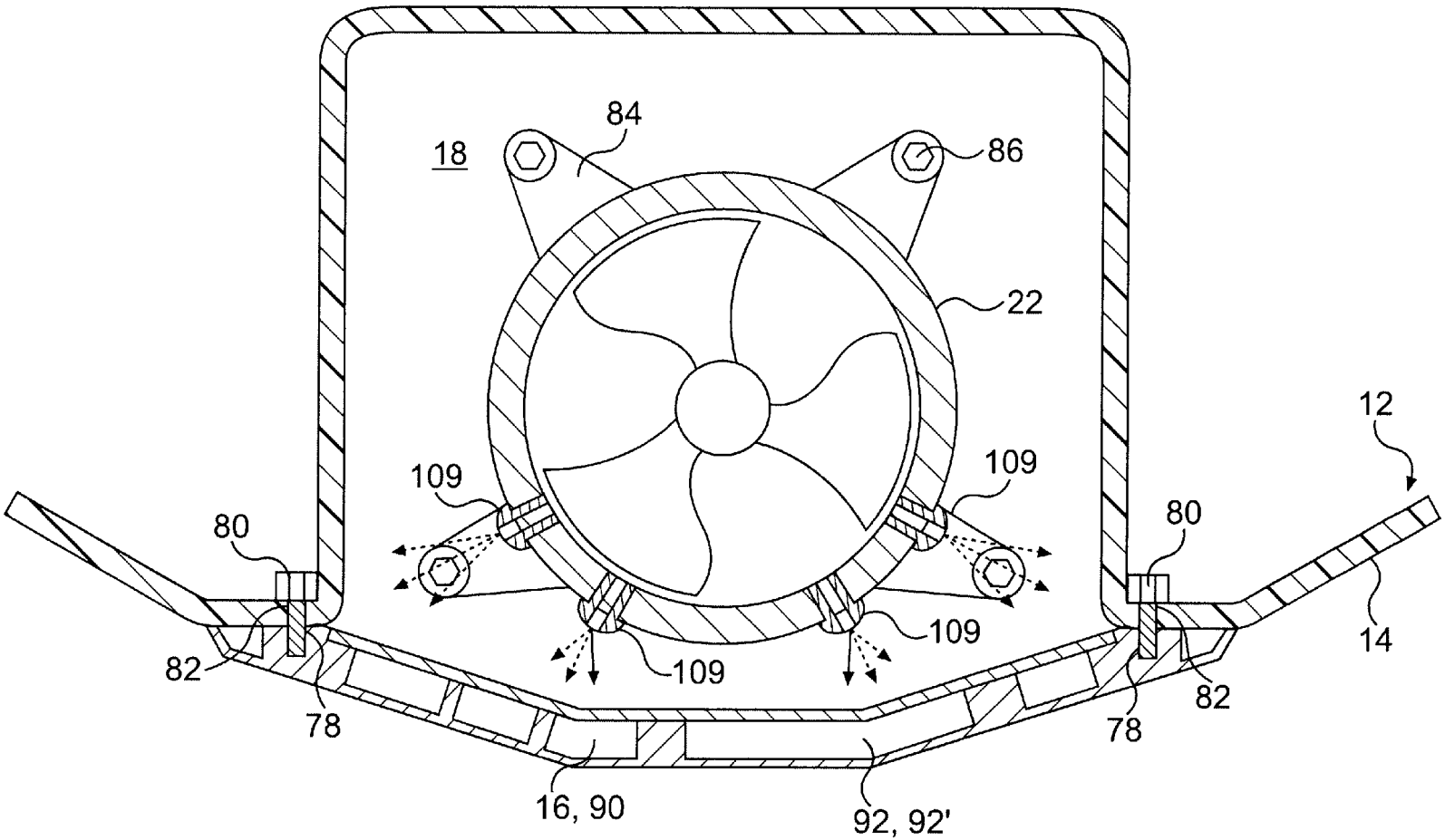
FIG. 6B is a cross-sectional view taken along line 6B in FIG. 6A.

The ride plate 16 includes a plurality of upwardly opening threaded openings 78, as shown in FIG. 6B. A plurality of threaded fasteners 80, in the form of threaded bolts, pass through associated openings 82 in the hull 12, from the interior thereof and threadedly engage openings 78, securing the ride plate 16 to the hull 12.

It is noted that the propulsion system 22 is mounted to the hull 12 such that it is disposed above the ride plate 16, within the impeller tunnel 18. The propulsion system 22 may have a plurality of connecting portions 84 extending radially outwardly from a forward portion thereof, as shown in FIG. 6B. It may be preferable for a corresponding plurality of threaded fasteners 86 to secure the propulsion system 22 to the hull 12. In this case each threaded fastener 86 passes through respective openings provided within each of the connecting portions 84 and through the hull 12 (at corresponding locations).

One purpose for the ride plate 16 is to provide a skimming surface for the PWC 10. At high speeds, a substantial portion of the hull 12 is lifted out of the body of water. In this situation the downwardly facing surface 70 of the ride plate 16 forms the skimming surface on which the PWC 10 travels. The rigidity of the ride plate 16 serves to protect the propulsion system 22 from damage caused by impacts with floating and/or submerged debris during such operating conditions.

Figure 7:
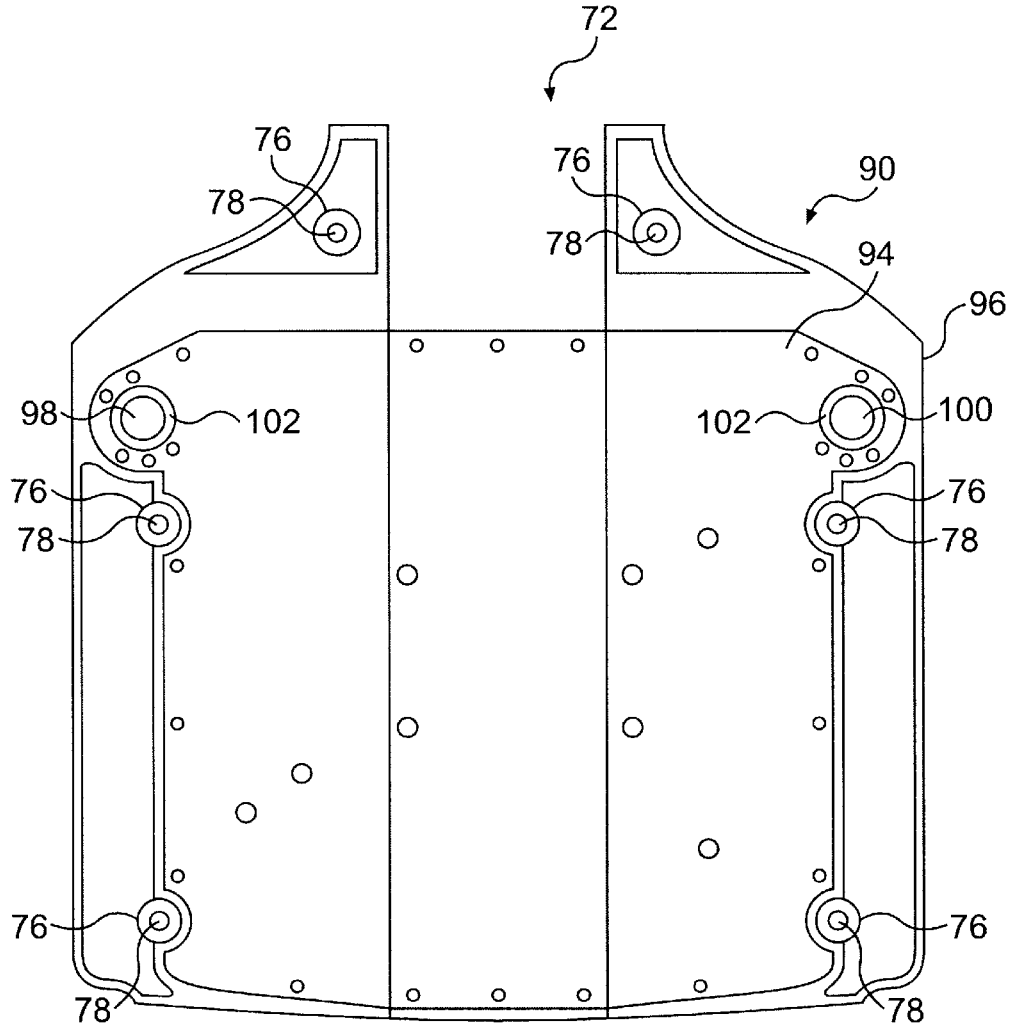
FIG. 7 is a top view of the ride plate with the top cover in covering relation to the bottom plate.
Figure 8:
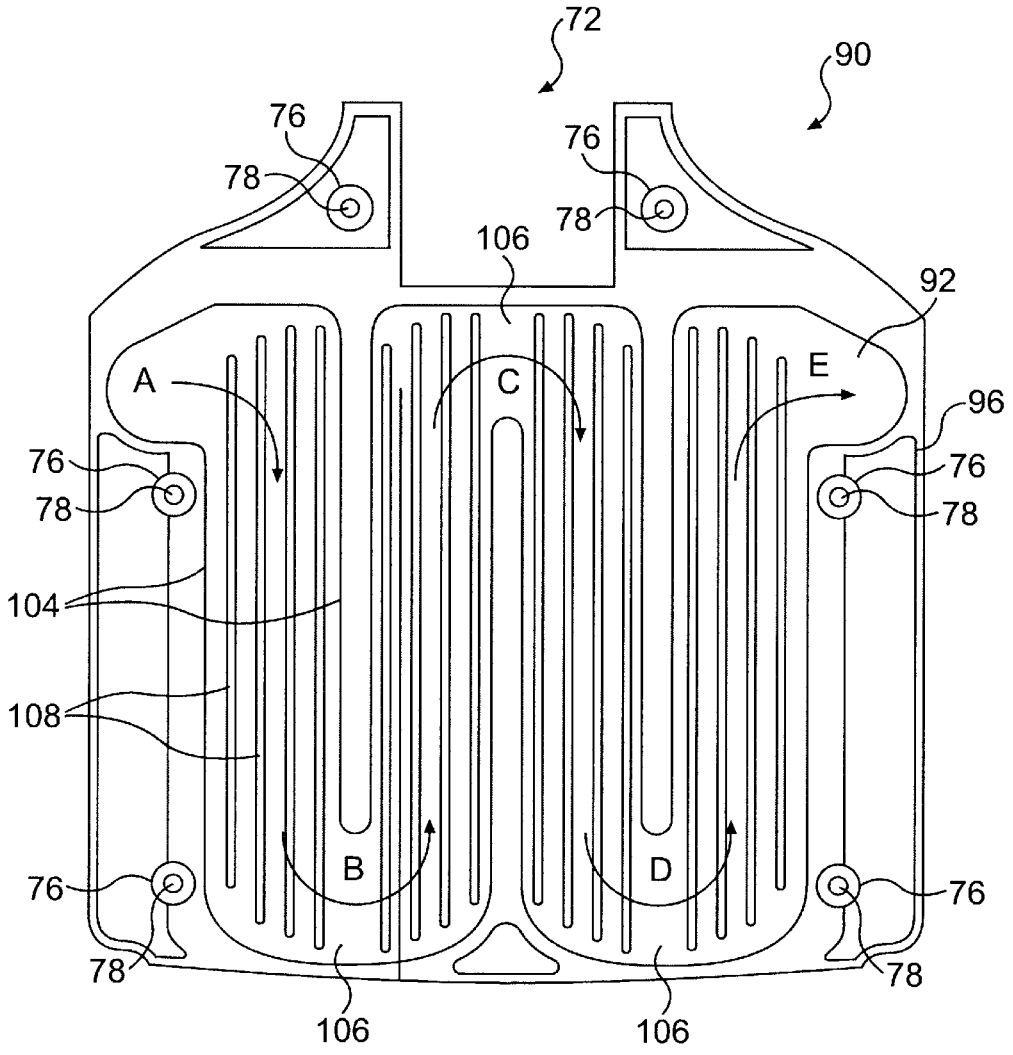
FIG. 8 is a top view of the bottom plate with one embodiment of the coolant path shown.

One embodiment of the cooling system of the invention is directed toward an integration of the heat exchanger 40 and the ride plate 16 into a heat exchanging ride plate 90. As shown in FIGS. 7 and 8, a heat exchanging ride plate 90 includes a coolant path 92 (FIG. 8) formed therein between a top plate 94 (FIG. 7) and a bottom plate 96. The integration of the heat exchanger 40 and the ride plate 16 is advantageous because the heat exchanging ride plate 90 is situated at the aft end of the PWC 10 and generally remains in contact with the body of water at all times (except during roll-over) as the PWC 10 travels along the surface of the body of water.

It is noted that the rider is often separated from the PWC 10 during roll-over. As such, it is customary in the art to provide an engine shut-off switch to shut-off the engine when the rider is separated from the PWC. Therefore, during roll-over, damage to the engine due to insufficient cooling caused by ride plate or heat exchanger exposure to the atmosphere is substantially prevented.

The heat exchanging ride plate 90 includes a heat exchanger body, which comprises the top and bottom plates 94, 96. The top plate 94 is positioned in covering relation to the bottom plate 96 and secured, for example, with threaded fastening devices around the periphery thereof to the bottom plate 96. It may be preferable to provide a seal between the top plate 94 and the bottom plate 96 to prevent leakage of the coolant from there between. It is contemplated that any of various heat-resistant sealants, such as high temperature resistant silicone-based sealant, or a gasket may be positioned between the top and bottom plates 94, 96 prior to fastening them together in order to from a seal therebetween. It is noted that it may be especially preferable to provide a seal between the plates 94, 96 when the coolant system utilizes a coolant such as a glycol-based fluid. The top plate 94 further includes an inlet port 98 and an outlet port 100, both disposed at a forward end thereof. The inlet and outlet ports 98, 100 provide upwardly extending circular flanges 102 that extend through the hull 12 at associated openings therein. Coolant hoses or pipes are fastened over the flanges 102 with associated clamping devices, connecting the heat exchanging ride plate 90 to the cooling system. The bottom plate 96 provides the downwardly facing surface 70, which when the heat exchanging ride plate 90 is mounted to the hull 12, is generally flush with and cooperates with the exterior surface 14 of the hull 12 to constitute a portion thereof, as shown in FIG. 6B.

The bottom plate 96 includes a plurality of upwardly extending channel walls 104 that interrelate to form the coolant path 92, as shown in FIG. 8. As indicated by arrows A through E (A represents inlet port location and E represents outlet port location), the coolant path 92 has a serpentine configuration with a plurality of U-shaped bends 106. In this manner, the coolant has a relatively long duration within the coolant path 92 with which to transfer heat to the heat exchanging ride plate 90. A series of parallel ribs 108 extend upwardly from the bottom plate 96 partially into the coolant path 92. The ribs 108 provide additional surface area for heat absorption by the heat exchanging ride plate 90 from the coolant and produces turbulence within the coolant flow that further expedites heat transfer. Heat dissipates from the coolant to the body of water by exterior surfaces of the heat exchanging ride plate 90 (especially from the downwardly facing exterior surface), such that a temperature T2 of the coolant exiting the heat exchanging ride plate 90 (at E in FIG. 8, prior to entering the coolant jacket 38) is lower than the temperature T1 of the coolant entering the heat exchanging ride plate 90 (at A in FIG. 8, after exiting the coolant jacket 38), so that T1>T2.

Figure 9:
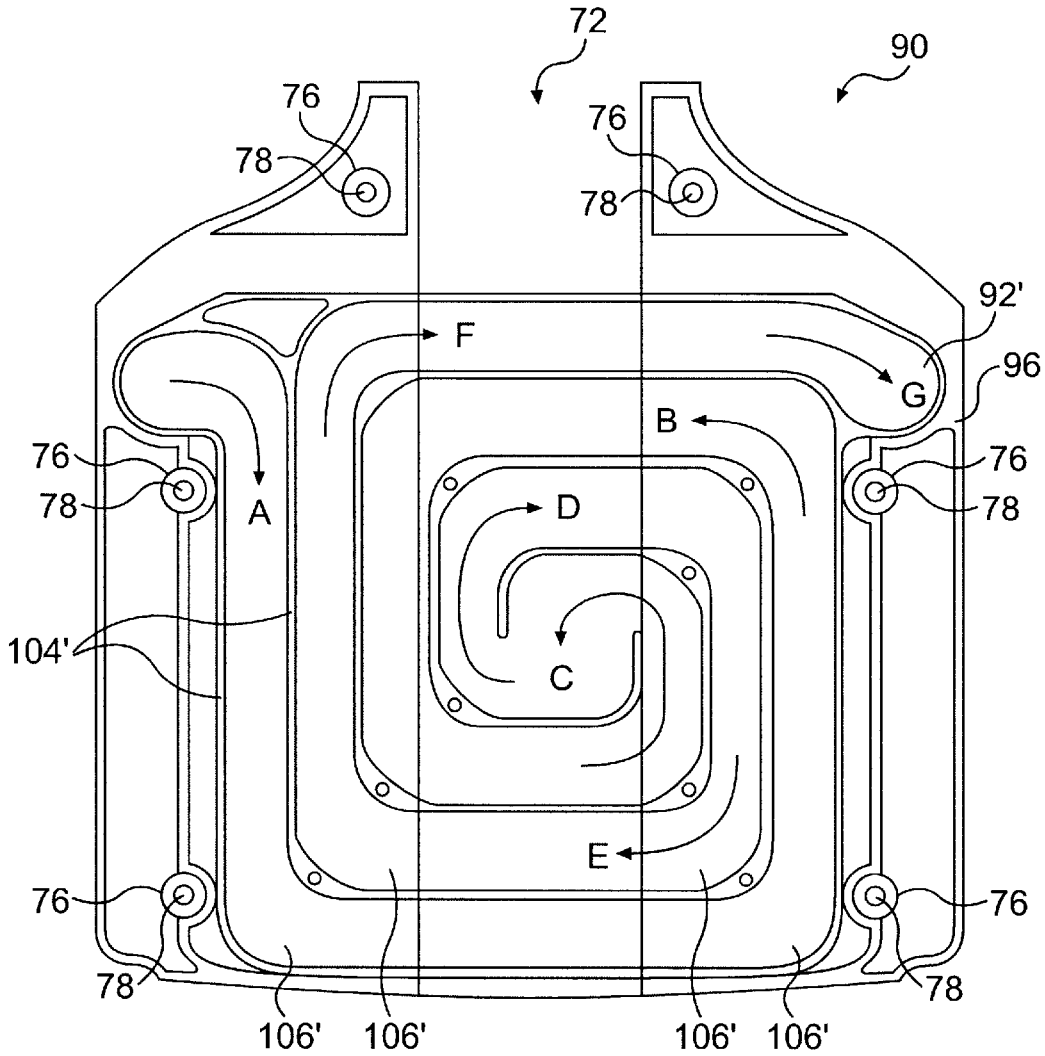
FIG. 9 is a top view of the bottom plate with an alternate embodiment of the coolant path shown.

Another embodiment of a coolant path through the heat exchanging ride plate 90 is shown in FIG. 9. A coolant path 92', defined by a plurality of upwardly protruding channel walls 104' (as in the above-described embodiment), has a spiraled configuration, which also provides a long duration for the heat exchanging ride plate 90 to absorb heat from the coolant. Additionally, the coolant path 92', indicated by arrows A–G (A represents inlet port location and G represents outlet port location), includes bends 106' that are predominantly 90° to minimize head loss within the heat exchanging ride plate 90 due to resistance in coolant flow through bends of larger angles, as in the U-shaped (180°) bends 106 (FIG. 8) of the above-described embodiment.

Head loss within the heat exchanging ride plate 90 is the reduction in pressure of the coolant therein. More specifically, the amount of head loss in the heat exchanging ride plate 90 is defined by the difference, $\Delta P$, between a pressure P1 of the coolant entering the heat exchanging ride plate 90 (at A in FIG. 9, after exiting the engine heat absorbing portion 30) and a pressure P2 of the coolant exiting the heat exchanging ride plate 90 (at G in FIG. 9, prior to entering the coolant jacket 38), or $P1-P2=\Delta P$. Substantial head loss may significantly reduce flow rate of the coolant through the heat exchanging ride plate 90, which may increase power necessary to circulate coolant through the cooling system or require use of a more powerful water pump 34 to maintain sufficient coolant flow through the cooling system, therefore it is advantageous to limit the amount of head loss through the heat exchanging ride plate 90. Head loss in the embodiment of FIG. 9 is reduced by providing the coolant path 92' that is predominately straight with bends 106' of smaller angles (e.g. 90° or less), such that resistance to coolant flow is limited. Furthermore, as shown in FIG. 9, the bends 106' in the coolant path 92' are arcuately configured, such that the bends 106' provide smooth transitions between altering directions of the coolant path 92'.

Other coolant paths through the heat exchanging ride plate 90 are contemplated, however preferable embodiments include those that produce a relatively long duration of exposure of the coolant to the heat exchanger, have a relatively large surface area and effect a minimal head loss on the coolant.

Referring to FIG. 6B, the propulsion system 22 may include a plurality of nozzles 109 that serve to direct water from the propulsion system 22 onto a top surface of the heat exchanging ride plate 90. As shown, nozzles 109 divert water from the high pressure stream generated by the impeller through a fluid path provided by the nozzles and direct that water onto the top surface of the ride plate 90. This arrangement facilitates cooling of the engine 20, especially at high speeds when the top surface of the ride plate 90 may not be immersed under the surface of the body of water and the propulsion system 22 generates a relatively large amount of water flow through nozzles 109.

Figure 10A:
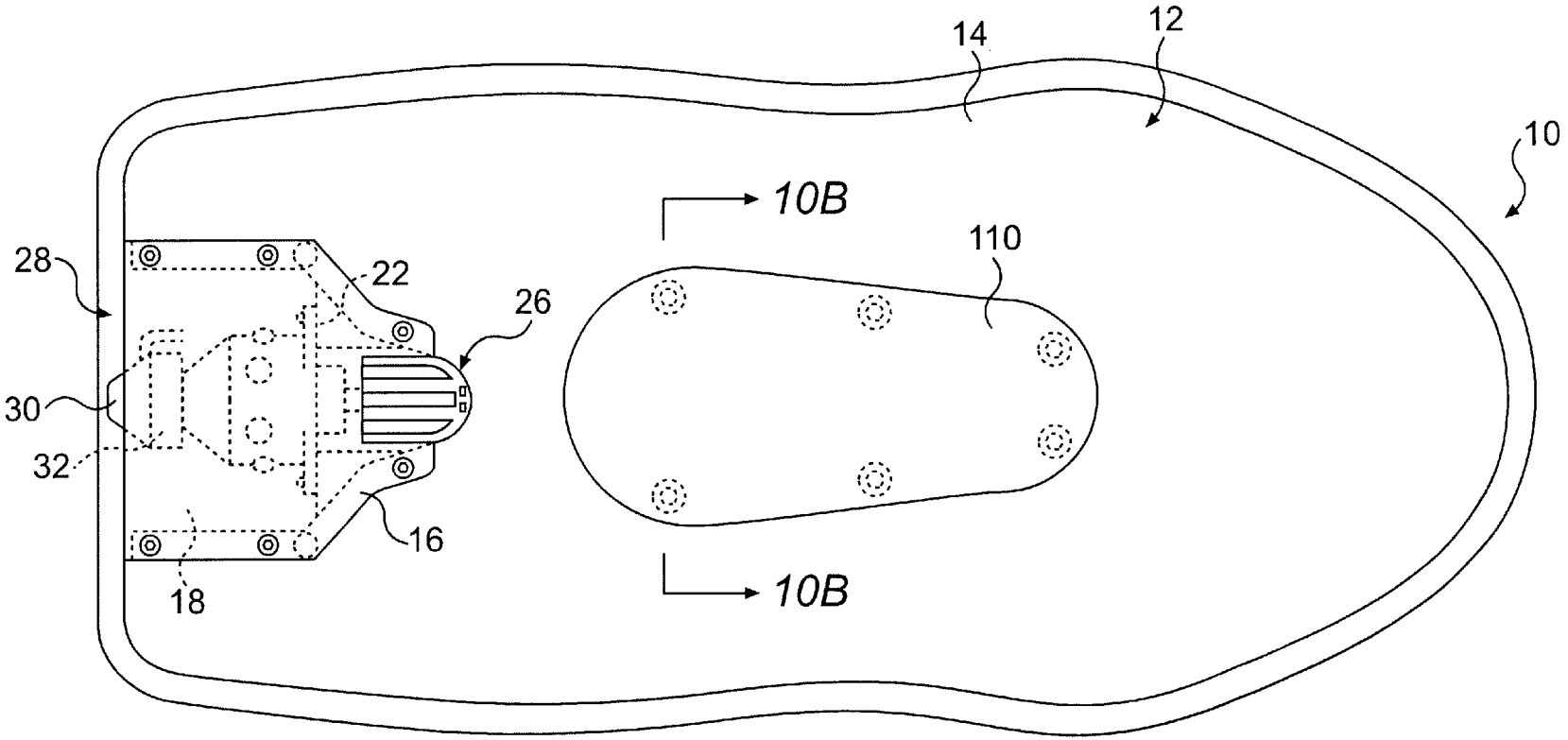
FIG. 10A is a bottom view of the personal watercraft with a single hull-mounted heat exchanger mounted forward of the ride plate.
Figure 10B:
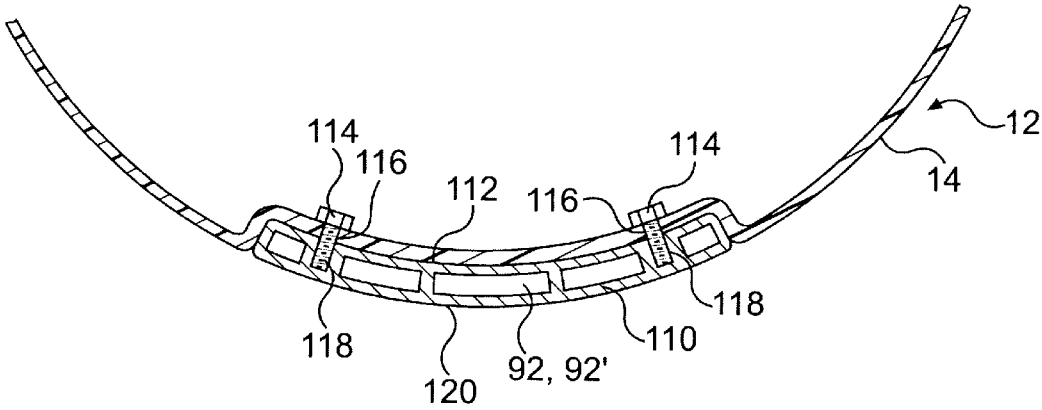
FIG. 10B is a cross-sectional view taken along line 10B in FIG. 10A.

Another embodiment of the heat exchanger, shown in FIG. 10A, is a single hull-mounted heat exchanger 110 that conforms to the exterior surface 14 of the hull 12 and is secured in a downwardly facing recess 112 (FIG. 10B), so as to be flush with the hull 12. As shown in FIG. 10B, the single hull-mounted heat exchanger 110 conforms to the exterior surface of the hull 14 and is secured thereto by, for example, threaded fastening devices 114, which extend through openings 116 in the hull 12 and threadedly engage within upwardly opening threaded recesses 118 within the single hull-mounted heat exchanger 110 (similar to the upwardly opening threaded recesses 78 in the ride plate heat exchanger 90). The single hull-mounted heat exchanger 110 of this embodiment may be located at any position on the hull 12. However, in order to cool the engine 20 properly, it may be advantageous for the single hull-mounted heat exchanger 110 to be positioned such that an exterior surface 120 is predominantly submerged in the body of water. Additionally, this embodiment will allow use of the single hull-mounted heat exchanger 110 with a larger surface area relative to the heat exchanging ride plate 90, since the single hull-mounted heat exchanger 110 is not confined to the ride plate 16. It may be advantageous for the single hull-mounted heat exchanger 110 to utilize one of the coolant paths 92, 92', as described herein above.

Figure 11A:
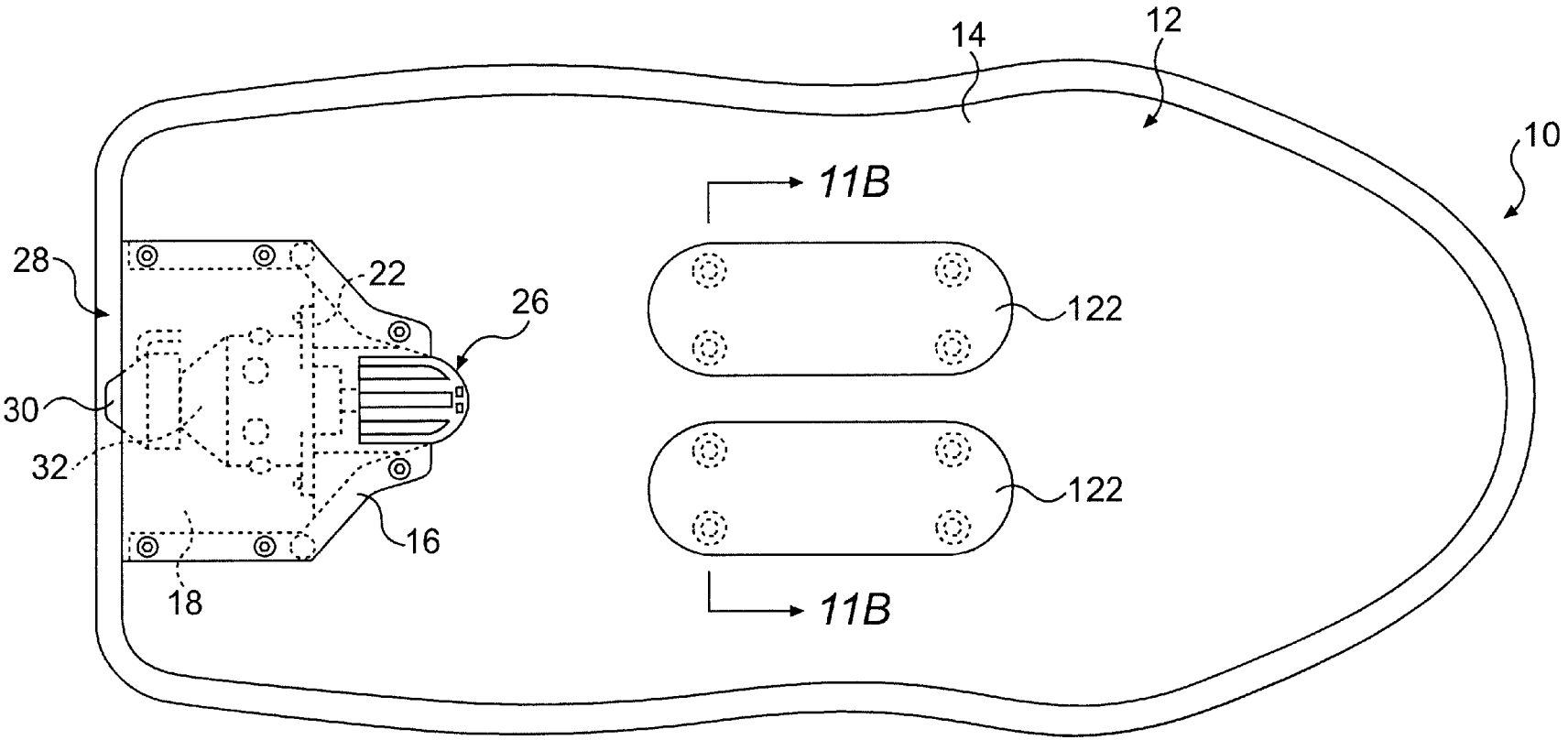
FIG. 11A is a bottom view of the personal watercraft with a starboard and port heat exchanger mounted forward of the ride plate.
Figure 11B:
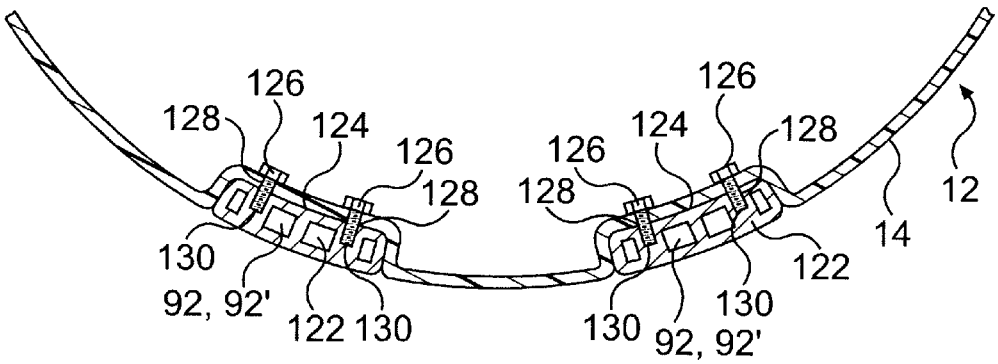
FIG. 11B is a cross-sectional view taken along line 11B in FIG. 11A.

Yet another embodiment of the invention is directed toward the use of port and starboard side hull-mounted heat exchangers 122 (FIG. 11A), which may be mounted within associated recesses 124 in the hull and integrated in series or parallel with each other and with or without the heat exchanging ride plate 90 described herein above. Shown in FIG. 11A, the port and starboard side hull-mounted heat exchangers 122 may be used in series or parallel to provide cooling for the engine 20. Shown in FIG. 11B, the port and starboard side hull-mounted heat exchangers 122 of this embodiment are mounted to the hull 12 in a similar manner as that for the above-described single hull-mounted heat exchanger 110 and may also utilize one of the coolant paths 92, 92', as described herein above. Threaded fastening devices 126 extend through openings 128 in the hull 12 and threadedly engage corresponding upwardly opening threaded recesses 130 in the port and starboard side hull-mounted heat exchangers 122.

It is contemplated that watercraft other than PWC may effectively utilize the present invention herein described. Additionally, a heat exchanger of any of the above-described embodiments may be used as a cooling system for other mediums that become heated during engine operation, for example, engine oil. For this purpose, engine oil. may be directed through the heat exchanger, as described herein above for the coolant, which provides additional cooling for the engine and maintains a higher viscosity of the oil (since oil exiting the heat exchanger is lower in temperature than oil entering the heat exchanger), which may be advantageous in watercraft with large engines. It is also contemplated that a plurality of fluid paths may be provided in a single heat exchanger to provide heat exchanging for a plurality of fluids within a single heat exchanger.

Figure 12:
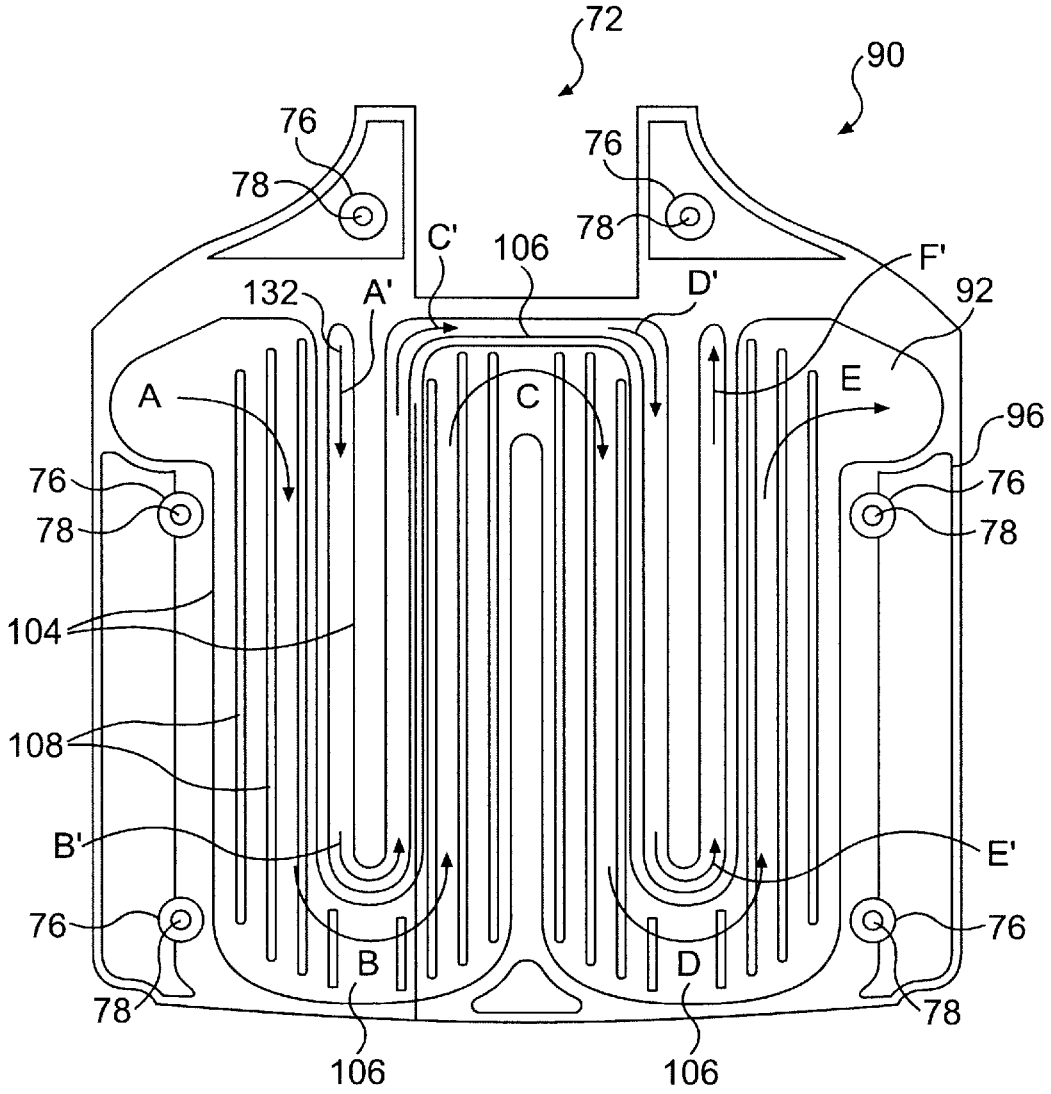
FIG. 12 is a top view of the bottom plate shown with multiple fluid paths.
Figure 13:
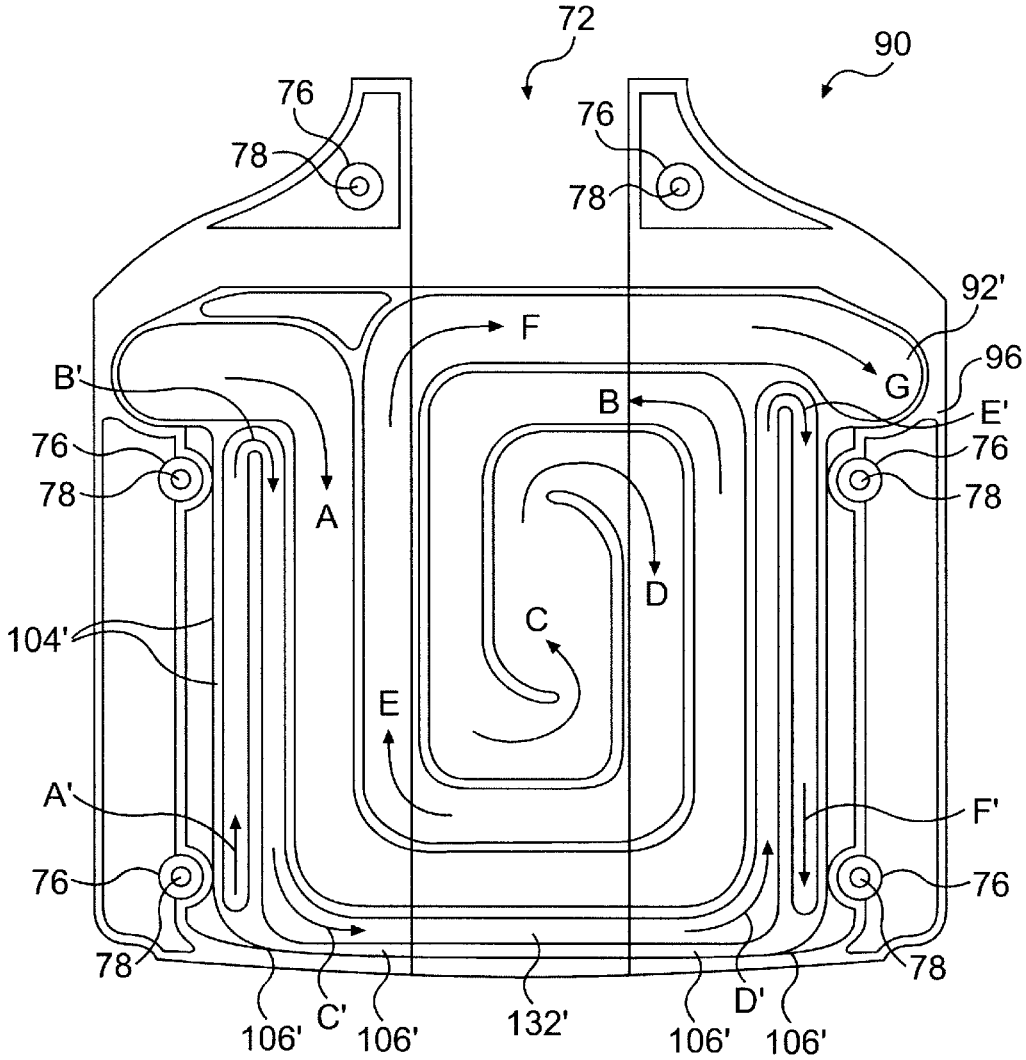
FIG. 13 is a top view of the bottom plate with an alternate embodiment of multiple fluid paths
Figure 14:
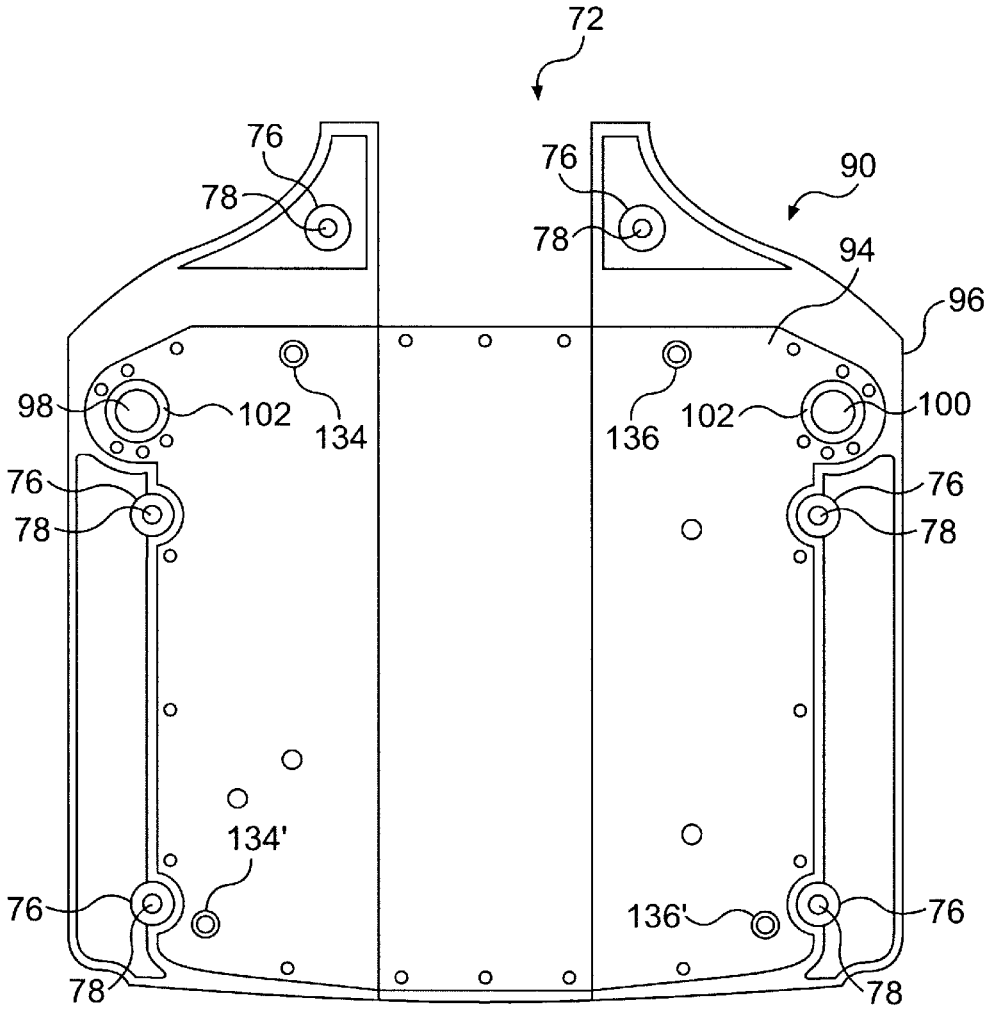
FIG. 14 is a top view of the heat exchanging ride plate with the top plate in position on the bottom plate, showing two possible locations for secondary inlet and outlet ports.

FIGS. 12 and 13 show two exemplary embodiments of a secondary fluid path, indicated at 132 and 132', respectively. The embodiments illustrated in FIGS. 12 and 13 show secondary fluid paths 132, 132' used in conjunction with coolant paths 92, 92', respectively. It is noted that these illustrated embodiments are for clarity only, and are not meant to be limiting. It is contemplated that the fluid paths may have any configuration enabling sufficient heat reduction of the fluid therein, as described hereinabove. FIG. 14 shows the top plate 94 mated to the bottom plate 96. As shown, the top plate 94 may have a secondary inlet port 134 and a secondary outlet port 136. The secondary inlet and outlet ports 134, 136 are communicated to either end of the secondary fluid path 132. As such, fluid from a system (an example is given below) may flow through the secondary fluid path 132 to be cooled within the hull-mounted heat exchanger of the present invention. FIG. 14 also shows secondary inlet and outlet ports 134' and 136', which may be communicated to fluid path 132' when used in conjunction with the appropriate corresponding bottom plate, shown in FIG. 13. It is noted that the top plate 94 of FIG. 14 shows both sets of inlet and outlet ports (134, 136 and 134', 136') for clarity only and is not meant to be limiting. Furthermore, it is contemplated that the top plate 94 may need more than one set of secondary inlet and outlet ports (134, 136 or 134', 136') only in an instance when there are more than one secondary fluid paths incorporated into the bottom plate 96. However, in the case where alternate fluid paths or multiple secondary fluid paths are possible, the top plate 94 may utilize more than one set of secondary inlet and outlet ports. It is of course possible and within the scope of the present invention, to incorporate multiple secondary fluid paths and inlet and outlet ports into any possible embodiment of the hull-mounted heat exchanger, including those embodiments described herein.

Figure 15:
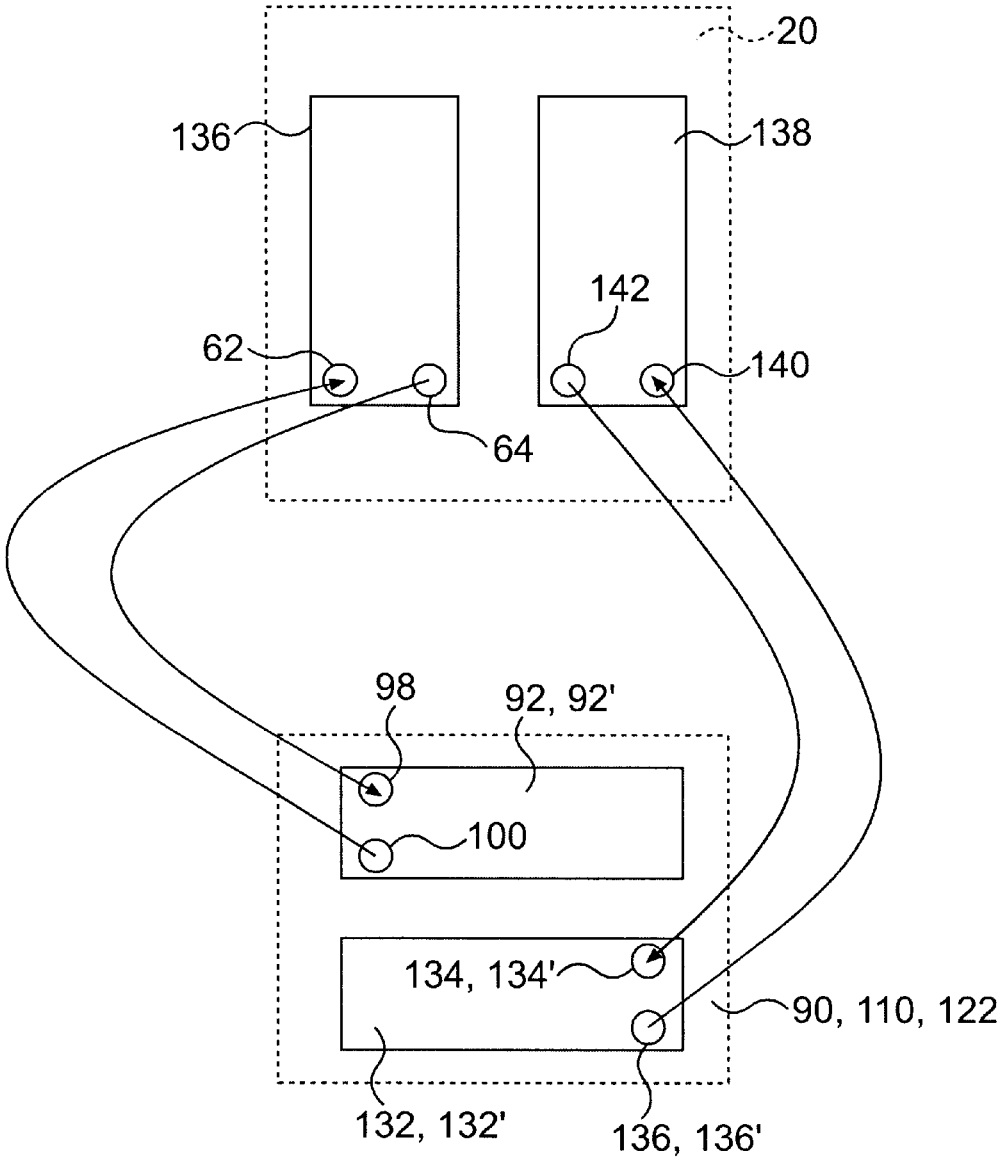
FIG. 15 is a schematic view showing the interaction between the hull mounted heat exchanger with multiple fluid paths and two fluid circulation systems of the engine.

An exemplary use of the hull mounted heat exchanger 40 utilizing a secondary fluid path may be used for cooling both engine coolant and, for example, engine oil, as shown schematically in FIG. 15. A four-stroke type engine 20 utilizes a closed circuit oil circulation system to deliver lubricant (oil) to various locations throughout the engine. The oil circulation system includes a lubrication delivery portion, an oil pump, and a filter and may include an oil pan or reservoir. The lubrication delivery portion (constructed and arranged to deliver lubrication to various components of the engine), the oil pump (constructed and arranged so as to cause the oil to flow through the oil circulation system), filter and oil pan are shown in FIG. 15 as an engine heat absorbing portion 138. Due to the proximity and interaction of the oil and engine components, the oil is exposed to and absorbs a large amount of heat. The relatively increased temperature of the oil reduces its viscosity, which may cause excessive wear between some interacting components of the engine. For this reason, it may be useful to cool the oil in order to maintain a relatively high viscosity of the oil. The engine heat absorbing portion 138 has inlet and outlet ports 140, 142 that are communicated to the secondary outlet and inlet ports 136, 134, respectively (shown in FIG. 12) with flexible hoses or rigid piping such that oil may flow through the secondary fluid path 132, 132'. While the oil flows through the secondary fluid path, some of the heat is absorbed by the conductive material of the heat exchanger 90, 110, 122 and may be dissipated in the body of water, as described previously for the engine coolant. As such, the temperature of the oil upon exit from the heat exchanger 90, 110, 122 (as might be measured at the outlet port 136, 136') is relatively lower than the temperature at which it entered (as might be measured at the inlet port 134, 134'), therefore the viscosity of the oil upon exit from the secondary fluid path is relatively greater than the viscosity at which it entered. By retaining a relatively higher viscosity of the engine oil, excessive wear of certain engine components may be reduced or prevented. Furthermore, cooling the engine oil also contributes to lowering the overall temperature of the engine, which may be advantageous, as described above. It is noted that the any embodiment of the hull mounted heat exchanger having a secondary fluid path may be used to cool engine oil.

The secondary fluid paths 132, 132' may be used to cool other various types of fluids including hydraulic fluid, when applicable (such as with larger watercraft). It is noted that any embodiment of the hull mounted heat exchanger of the present invention may utilize one or more secondary coolant paths to cool one or more fluids. It is further noted that the illustrated embodiments of fluid paths 92, 92', 132 and 132' are examples of varying configurations of fluid paths that are possible within the heat exchanger of the present invention, and are not meant to be limitations.

Additionally, it is contemplated that a drain pathway (not shown) may be provided in any embodiment of the hull mounted heat exchanger of the present invention, such that fluid present in the hull mounted heat exchanger (and those fluid systems that are communicated thereto) may be removed. It is noted that for embodiments of the hull mounted heat exchanger including multiple fluid paths, multiple drain pathways may be provided to independently drain fluid therefrom. Preferably, the drain pathway(s) is(are) threaded openings wherein a threaded drain plug may be inserted and threadedly secured therein. It is noted that providing drain pathways within the hull mounted heat exchanger may be advantageous since, in the various embodiments, the hull mounted heat exchanger is located at a relatively low position on the PWC and may facilitate draining those systems with which the fluid pathway(s) is(are) communicated.

Figure 16A:
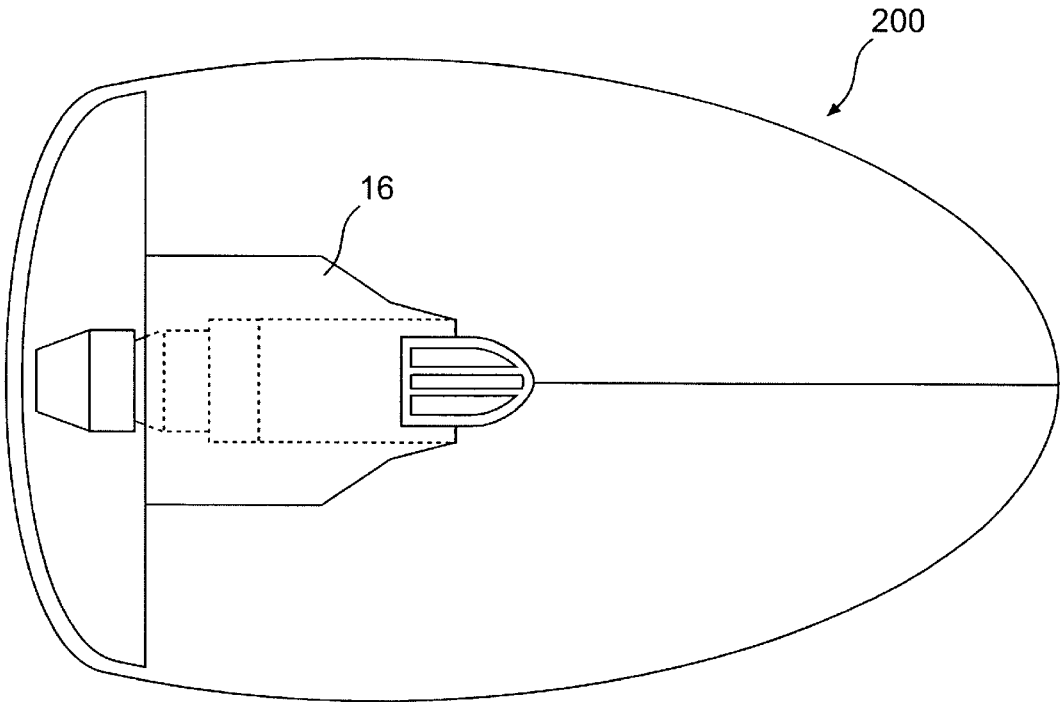
FIG. 16A is a bottom schematic view of a sport boat in accordance with the invention.
Figure 16B:
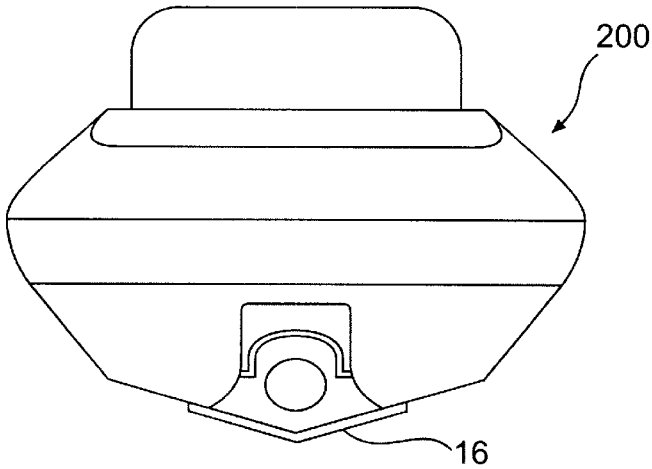
FIG. 16B is a back schematic view of the sport boat of FIG. 16A.

FIGS. 16A and 16B show a sport boat 200 in accordance with this invention with a heat exchanger in the form of a ride plate 210, which has the same construction as ride plate 16 described above.

It will be appreciated that numerous modifications to and departures from the embodiments of the invention described above will occur to those having skill in the art. Such further embodiments are deemed to be within the scope of the following claims.

What is claimed is:

1. A watercraft comprising:

a hull having an exterior surface with a tunnel formed therein, wherein at least a portion of the hull is submerged in a body of water;

an engine that generates power supported by the hull;

a propulsion system positioned in the tunnel and operatively connected to the engine to propel the watercraft across the body of water using the power generated by the engine;

a circulating system containing a supply of coolant that flows through the circulating system during operation of the engine, wherein the circulating system includes an engine heat absorbing portion, which is positioned adjacent portions of the engine that generate heat during operation to facilitate heat transfer to the coolant, and a heat exchanger, which is positioned at the exterior surface of the hull and forms the bottom of the tunnel to facilitate heat transfer from the coolant to the body of water, wherein the heat exchanger forms a ride plate that is at least partially formed from a heat conductive material and has a coolant fluid path defined therein with an inlet port and an outlet port in communication with the engine heat absorbing portion, wherein the tunnel is defined by a groove formed in the hull having a width that is transverse to a center line of the watercraft, and wherein the ride plate extends across the width of the tunnel.

2. A watercraft according to claim wherein said tunnel has a rearward discharge opening at the stem and a forward intake opening spaced forwardly of said discharge opening, said propulsion system including an impeller assembly secured to said hull within said tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft.

3. A watercraft according to claim 2, wherein said heat exchanger comprises a base portion providing an open partial fluid path and a cover portion coupled to said base portion so as to close said open partial fluid path to form a portion of said circulating system.

4. A watercraft according to claim 3, wherein said coolant fluid path has a serpentine configuration comprising a series of adjacent straight paths including a first straight path, and second straight path, and one or more intermediate straight paths, said first straight path communicating with said inlet port on one end and one of said one or more intermediate straight paths on an opposite end thereof, said second straight path communicating with one end of said outlet port and one of said one or more intermediate straight paths on an opposite end thereof, each of said one or more intermediate paths being connected at each end to one of said first and second straight paths and one of said one or more intermediate paths.

5. A watercraft according to claim 3, wherein said coolant fluid path has a spiraled configuration comprising an inwardly spiraled fluid path and a outwardly spiraled fluid path, said fluid paths communicated at innermost ends to each other proximate a center of said heat exchanger, said inwardly spiraled fluid path communicated at an outermost end to said inlet port and said outwardly spiraled fluid path communicated at an outermost end to said outlet port, one of said inwardly spiraled fluid path and said outwardly spiraled fluid path being nested within the other of said inwardly spiraled fluid path and said outwardly spiraled fluid path.

6. A watercraft according to claim 1, wherein said heat conductive material is metal.

7. A watercraft according to claim 6, wherein said metal is aluminum.

8. A watercraft according to claim 1, wherein said watercraft is a personal watercraft.

9. A watercraft according to claim 1, wherein said watercraft is a sport boat.

10. A watercraft according to claim 1, wherein said engine is an internal combustion engine.

11. A watercraft according to claim 10, wherein said internal combustion engine is a four-stroke engine.

12. A watercraft according to claim 10, wherein said internal combustion engine is a two-stroke engine.

13. A watercraft according to claim 1, wherein said coolant comprises glycol.

14. A watercraft according to claim 13, wherein said coolant further comprises water mixed together with said glycol.

15. The watercraft of claim 1, wherein the ride plate includes a partial intake opening that cooperates with an intake opening in the hull to the tunnel to allow water to be drawn into the propulsion system.

16. The watercraft of claim 15, wherein the partial intake opening is defined by an edge of the ride plate.

17. The watercraft of claim 1, wherein the ride plate has a lower solid plate-like surface of the heat conductive material.

18. The watercraft of claim 1, wherein the circulating system is a closed loop system.

19. The watercraft of claim 1, wherein the coolant fluid path in the heat exchanger extends substantially across the width of the tunnel thereby maximizing heat exchanging surface area.

20. A watercraft for travelling along a surface of a body of water, said watercraft comprising:

a hull having an exterior surface;

an engine constructed and arranged to generate power and heat;

a propulsion system operatively connected to said engine and being constructed and arranged to propel said watercraft along the surface of the body of water using the power generated by said engine;

a closed coolant circulating system containing a supply of coolant that is caused to flow through said coolant circulating system during operation of said engine, said circulating system having an engine heat absorbing portion through which said coolant flows, said engine heat absorbing portion being positioned with respect to said engine such that at least a portion of the heat generated by said engine is absorbed by said heat absorbing portion and the coolant flowing therethrough; and at least one heat exchanger formed from a heat conductive material and having a fluid path defined therein with an inlet port and an outlet port, said heat exchanger having a heat exchanging exterior surface and being mounted to said hull such that the heat exchanging exterior surface constitutes a portion of the exterior surface of said hull that is normally disposed below the surface of the body of water when said watercraft is in an upright position;

said inlet and outlet ports being respectively communicated to said engine heat absorbing portion such that said heat exchanging fluid path constitutes a portion of said coolant circulating system with said coolant flowing into said heat exchanging fluid path from said heat absorbing portion via said inlet port and from said fluid path back to said heat absorbing portion via said outlet port, said heat conductive material of said heat exchanger allowing the heat absorbed from said engine by said coolant to dissipate from said coolant to the body of water via said heat exchanging exterior surface as said coolant flows through said heat exchanging fluid path, and further comprising another closed coolant circulating system containing a supply of another coolant that is caused to flow through said another coolant circulating system during operation of said engine, said another circulating system having an engine heat absorbing portion through which said another coolant flows, said engine heat absorbing portion being positioned with respect to said engine such that at least a portion of the heat generated by said engine is absorbed by said engine heat absorbing portion and the another coolant flowing therethrough; and wherein said heat exchanger has another fluid path defined therein separate from said fluid path and with an inlet port and an outlet port, said another fluid path forming a portion of one of a plurality of additional fluid circulating systems other than said coolant circulating system;

said inlet and outlet ports being respectively communicated to said engine heat absorbing portion such that said another fluid path constitutes a portion of said another coolant circulating system with said another coolant flowing into said another fluid path from said heat absorbing portion via said inlet port and from said another fluid path back to said heat absorbing portion via said outlet port, said heat conductive material of said heat exchanger allowing the heat absorbed from said engine by said another coolant to dissipate from said another coolant to the body of water via said heat exchanging exterior surface as said another coolant flows through said another fluid path.

21. A watercraft for travelling along a surface of a body of water, said watercraft comprising:

a hull having an exterior surface;

an engine constructed and arranged to generate power and heat;

a propulsion system operatively connected to said engine and being constructed and arranged to propel said watercraft along the surface of the body of water using the power generated by said engine;

a closed coolant circulating system containing a supply of coolant that is caused to flow through said coolant circulating system during operation of said engine, said circulating system having an engine heat absorbing portion through which said coolant flows, said engine heat absorbing portion being positioned with respect to said engine such that at least a portion of the heat generated by said engine is absorbed by said heat absorbing portion and the coolant flowing therethrough; and at least one heat exchanger formed from a heat conductive material and having a fluid path defined therein with an inlet port and an outlet port, said heat exchanger having a heat exchanging exterior surface and being mounted to said hull such that the heat exchanging exterior surface constitutes a portion of the exterior surface of said hull that is normally disposed below the surface of the body of water when said watercraft is in an upright position;

said inlet and outlet ports being respectively communicated to said engine heat absorbing portion such that said heat exchanging fluid path constitutes a portion of said coolant circulating system with said coolant flowing into said heat exchanging fluid path from said heat absorbing portion via said inlet port and from said fluid path back to said heat absorbing portion via said outlet port, said heat conductive material of said heat exchanger allowing the heat absorbed from said engine by said coolant to dissipate from said coolant to the body of water via said heat exchanging exterior surface as said coolant flows through said heat exchanging fluid path, wherein said heat exchanger has a plate-like configuration with an upwardly facing surface and downwardly facing surface, and said plate-like heat exchanger is a ride plate mounted at an underside stern portion of said hull along a centerline thereof, and wherein said heat exchanger and said hull define an impeller tunnel having a rearward discharge opening at the stern and a forward intake opening spaced forwardly of said discharge opening, said propulsion system including an impeller assembly secured to said hull within said tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft, and wherein said impeller assembly comprises one or more fluid paths extending from an inner periphery of said impeller assembly to an external periphery thereof, said one or more fluid paths being constructed and arranged such that a portion of the water flowing through said impeller assembly during operation of the propulsion system is directed onto said upwardly facing surface of said heat exchanger, said heat conductive material of said heat exchanger allowing a portion of the heat absorbed from said engine by said coolant to dissipate from said coolant to the body of water via the water directed onto said upwardly facing surface as said coolant flows through said heat exchanging fluid path.

22. A watercraft for travelling along a surface of a body of water, said watercraft comprising:

a hull having an exterior surface;

an engine constructed and arranged to generate power and heat;

a propulsion system operatively connected to said engine and being constructed and arranged to propel said watercraft along the surface of the body of water using the power generated by said engine;

a closed coolant circulating system containing a supply of coolant that is caused to flow through said coolant circulating system during operation of said engine, said circulating system having an engine heat absorbing portion through which said coolant flows, said engine heat absorbing portion being positioned with respect to said engine such that at least a portion of the heat generated by said engine is absorbed by said heat absorbing portion and the coolant flowing therethrough; and at least one heat exchanger formed from a heat conductive material and having a fluid path defined therein with an inlet port and an outlet port, said heat exchanger having a heat exchanging exterior surface and being mounted to said hull such that the heat exchanging exterior surface constitutes a portion of the exterior surface of said hull that is normally disposed below the surface of the body of water when said watercraft is in an upright position;

said inlet and outlet ports being respectively communicated to said engine heat absorbing portion such that said heat exchanging fluid path constitutes a portion of said coolant circulating system with said coolant flowing into said heat exchanging fluid path from said heat absorbing portion via said inlet port and from said fluid path back to said heat absorbing portion via said outlet port, said heat conductive material of said heat exchanger allowing the heat absorbed from said engine by said coolant to dissipate from said coolant to the body of water via said heat exchanging exterior surface as said coolant flows through said heat exchanging fluid path, wherein the heat exchanging exterior surface of said heat exchanger is recessed in the hull to be flush with portions of said exterior surface of said hull immediately adjacent thereto wherein the hull has a downwardly facing recess and the heat exchanger is mounted within the recess to conform to the exterior surface of the hull, wherein the recess is a single recess positioned in a central portion of the hull, further comprising a ride plate coupled to the hull, wherein the recess is spaced from the ride plate.

23. A watercraft comprising:

a hull having an exterior surface with a tunnel formed therein, wherein at least a portion of the hull is submerged in a body of water;

an engine that generates power supported by the hull;

a propulsion system positioned in the tunnel and operatively connected to the engine to propel the watercraft across the body of water using the power generated by the engine;

a circulating system containing a supply of coolant that flows through the circulating system during operation of the engine, wherein the circulating system includes an engine heat absorbing portion, which is positioned adjacent portions of the engine that generate heat during operation to facilitate heat transfer to the coolant, and a heat exchanger, which is positioned at the exterior surface of the hull and forms the bottom of the tunnel to facilitate heat transfer from the coolant to the body of water, wherein the heat exchanger forms a ride plate that is at least partially formed from a heat conductive material and has a coolant fluid path defined therein with an inlet port and an outlet port in communication with the engine heat absorbing portion, wherein the ride plate includes a two-piece member having the coolant fluid path defined therebetween, with each piece extending the full width of the tunnel.

24. A watercraft according to claim 23, wherein said tunnel has a rearward discharge opening at the stern and a forward intake opening spaced forwardly of said discharge opening, said propulsion system including an impeller assembly secured to said hull within said tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft.

25. A watercraft according to claim 24, wherein said two-piece member comprises a base portion providing an open partial fluid path and a cover portion coupled to said base portion so as to close said open partial fluid path to form a portion of said circulating system.

26. A watercraft according to claim 25, wherein said coolant fluid path has a serpentine configuration comprising a series of adjacent straight paths including a first straight path, and second straight path, and one or more intermediate straight paths, said first straight path communicating with said inlet port on one end and one of said one or more intermediate straight paths on an opposite end thereof, said second straight path communicating with one end of said outlet port and one of said one or more intermediate straight paths on an opposite end thereof, each of said one or more intermediate paths being connected at each end to one of said first and second straight paths and one of said one or more intermediate paths.

27. A watercraft according to claim 25, wherein said coolant fluid path has a spiraled configuration comprising an inwardly spiraled fluid path and a outwardly spiraled fluid path, said fluid paths communicated at innermost ends to each other proximate a center of said heat exchanger, said inwardly spiraled fluid path communicated at an outermost end to said inlet port and said outwardly spiraled fluid path communicated at an outermost end to said outlet port, one of said inwardly spiraled fluid path and said outwardly spiraled fluid path being nested within the other of said inwardly spiraled fluid path and said outwardly spiraled fluid path.

28. A watercraft according to claim 23, wherein said heat conductive material is metal.

29. A watercraft according to claim 28, wherein said metal is aluminum.

30. A watercraft according to claim 23, wherein said watercraft is a personal watercraft.

31. A watercraft according to claim 30, wherein said watercraft is a sport boat.

32. A watercraft according to claim 23, wherein said engine is an internal combustion engine.

33. A watercraft according to claim 32, wherein said internal combustion engine is a four-stroke engine.

34. A watercraft according to claim 32, wherein said internal combustion engine is a two-stroke engine.

35. A watercraft according to claim 23, wherein said coolant comprises glycol.

36. A watercraft according to claim 35, wherein said coolant further comprises water mixed together with said glycol.

37. A watercraft according to claim 23, wherein the ride plate includes a partial intake opening that cooperates with an intake opening in the hull to the tunnel to allow water to be drawn into the propulsion system.

38. A watercraft according to claim 37, wherein the partial intake opening is defined by an edge of the ride plate.

39. A watercraft according to claim 23, wherein the ride plate has a lower solid plate-like surface of the heat conductive material.

40. A watercraft according to claim 23, wherein the circulating system is a closed loop system.

41. A watercraft comprising:

a hull having an exterior surface with a tunnel formed therein, wherein at least a portion of the hull is submerged in a body of water;

an engine that generates power supported by the hull;

a propulsion system positioned in the tunnel and operatively connected to the engine to propel the watercraft across the body of water using the power generated by the engine;

a circulating system containing a supply of coolant that flows through the circulating system during operation of the engine, wherein the circulating system includes an engine heat absorbing portion, which is positioned adjacent portions of the engine that generate heat during operation to facilitate heat transfer to the coolant, and a heat exchanger, which is positioned at the exterior surface of the hull and forms the bottom of the tunnel to facilitate heat transfer from the coolant to the body of water, wherein the heat exchanger forms a ride plate that is at least partially formed from a heat conductive material and has a coolant fluid path defined therein with an inlet port and an outlet port in communication with the engine heat absorbing portion, further comprising fasteners that connect the ride plate to the hull, wherein the fasteners extend through the ride plate and the hull such that the ride plate overlaps the exterior surface of the hull.

42. A watercraft according to claim 41, wherein said tunnel has a rearward discharge opening at the stern and a forward intake opening spaced forwardly of said discharge opening, said propulsion system including an impeller assembly secured to said hull within said tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft.

43. A watercraft according to claim 42, wherein said heat exchanger comprises a base portion providing an open partial fluid path and a cover portion coupled to said base portion so as to close said open partial fluid path to form a portion of said circulating system.

44. A watercraft according to claim 43, wherein said coolant fluid path has a serpentine configuration comprising a series of adjacent straight paths including a first straight path, and second straight path, and one or more intermediate straight paths, said first straight path communicating with said inlet port on one end and one of said one or more intermediate straight paths on an opposite end thereof, said second straight path communicating with one end of said outlet port and one of said one or more intermediate straight paths on an opposite end thereof, each of said one or more intermediate paths being connected at each end to one of said first and second straight paths and one of said one or more intermediate paths.

45. A watercraft according to claim 43, wherein said coolant fluid path has a spiraled configuration comprising an inwardly spiraled fluid path and a outwardly spiraled fluid path, said fluid paths communicated at innermost ends to each other proximate a center of said heat exchanger, said inwardly spiraled fluid path communicated at an outermost end to said inlet port and said outwardly spiraled fluid path communicated at an outermost end to said outlet port, one of said inwardly spiraled fluid path and said outwardly spiraled fluid path being nested within the other of said inwardly spiraled fluid path and said outwardly spiraled fluid path.

46. A watercraft according to claim 41, wherein said heat conductive material is metal.

47. A watercraft according to claim 46, wherein said metal is aluminum.

48. A watercraft according to claim 41, wherein said watercraft is a personal watercraft.

49. A watercraft according to claim 41, wherein said watercraft is a sport boat.

50. A watercraft according to claim 41, wherein said engine is an internal combustion engine.

51. A watercraft according to claim 50, wherein said internal combustion engine is a four-stroke engine.

52. A watercraft according to claim 50, wherein said internal combustion engine is a two-stroke engine.

53. A watercraft according to claim 41, wherein said coolant comprises glycol.

54. A watercraft according to claim 53, wherein said coolant further comprises water mixed together with said glycol.

55. The watercraft of claim 41, wherein the ride plate includes a partial intake opening that cooperates with an intake opening in the hull to the tunnel to allow water to be drawn into the propulsion system.

56. The watercraft of claim 55, wherein the partial intake opening is defined by an edge of the ride plate.

57. The watercraft of claim 41, wherein the ride plate has a lower solid plate-like surface of the heat conductive material.

58. The watercraft of claim 41, wherein the circulating system is a closed loop system.

59. A ride plate for mounting to the bottom hull portion of a watercraft over a tunnel that houses the watercraft propulsion system, wherein the watercraft includes a power source that is connected to the propulsion system and has a coolant circulating system, the ride plate comprising:

a heat exchanger body having a fluid path defined therein with an inlet port and an outlet port for connection to the coolant circulating system of the power source, the heat exchanger body including a heat exchanging exterior surface adjacent the fluid path for absorbing heat from fluid in the coolant circulating system, the heat exchanger body also including a peripheral edge with fastening formations for connection to the bottom hull portion of the watercraft, wherein the heat exchanger body is formed at least partially from a heat conductive material, wherein the heat exchanger body has a secondary fluid path, a second inlet and a second outlet connectable to a fluid source from the power source.

60. A ride plate according to claim 59, in combination with a watercraft having a hull, an engine and a propulsion system, wherein said heat exchanger body is cooperable with said hull to define an impeller tunnel having a rearward discharge opening at the stern and a forward intake opening spaced forwardly of said rearward discharge opening, said propulsion system including an impeller assembly secured to said hull within said impeller tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft.

61. A ride plate according to claim 60, wherein the heat exchanger body is mounted to said hull such that said exterior surface of said heat exchanger body is flush with portions of said exterior surface of said hull immediately adjacent thereto.

62. A ride plate according to claim 59, wherein the heat exchanging exterior surface is a plate-like skimming surface for facilitating skimming of the watercraft over water at high speeds.

63. A ride plate according to claim 59, wherein the fastening formations include a plurality of apertures, and further comprising threaded fasteners retained in the apertures.

64. A ride plate according to claim 59, wherein the heat exchanger body comprises a top plate and a bottom plate secured together and defining the fluid path therebetween.

65. A ride plate according to claim 59, wherein the fluid path has a serpentine configuration with a plurality of U-shaped bends.

66. A ride plate according to claim 59, wherein the fluid path has a spiraled configuration.

67. A watercraft for travelling along a surface of a body of water, said watercraft comprising:

a hull having an exterior surface;

an engine constructed and arranged to generate power and heat;

a propulsion system operatively connected to said engine and being constructed and arranged to propel said watercraft along the surface of the body of water using the power generated by said engine;

a closed coolant circulating system containing a supply of coolant that is caused to flow through said coolant circulating system during operation of said engine, said circulating system having an engine heat absorbing portion through which said coolant flows, said engine heat absorbing portion being positioned with respect to said engine such that at least a portion of the heat generated by said engine is absorbed by said heat absorbing portion and the coolant flowing therethrough; and at least one heat exchanger formed from a heat conductive material and having a fluid path defined therein with an inlet port and an outlet port, said heat exchanger having a heat exchanging exterior surface and being mounted to said hull such that the heat exchanging exterior surface constitutes a portion of the exterior surface of said hull that is normally disposed below the surface of the body of water when said watercraft is in an upright position;

said inlet and outlet ports being respectively communicated to said engine heat absorbing portion such that said heat exchanging fluid path constitutes a portion of said coolant circulating system with said coolant flowing into said heat exchanging fluid path from said heat absorbing portion via said inlet port and from said fluid path back to said heat absorbing portion via said outlet poll, said heat conductive material of said heat exchanger allowing the heat absorbed from said engine by said coolant to dissipate from said coolant to the body of water via said heat exchanging exterior surface as said coolant flows through said heat exchanging fluid path, wherein said heat exchanger has a plate-like configuration with an upwardly facing surface and downwardly facing surface, and said plate-like heat exchanger is a ride plate mounted at an underside stern portion of said hull along a centerline thereof, and wherein said heat exchanger and said hull define an impeller tunnel having a rearward discharge opening at the stern and a forward intake opening spaced forwardly of said discharge opening, said propulsion system including an impeller assembly secured to said hull within said tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft, and wherein said impeller assembly comprises one or more fluid paths extending from an inner periphery of said impeller assembly to an external periphery thereof, said one or more fluid paths being constructed and arranged such that a portion of the water flowing through said impeller assembly is directed onto said upwardly facing surface of said heat exchanger, said heat conductive material of said heat exchanger allowing a portion of the heat absorbed from said engine by said coolant to dissipate from said coolant to the body of water via the water directed onto said upwardly facing surface as said coolant flows through said heat exchanging fluid path, wherein the propulsion system includes a plurality of nozzles extending from the impeller assembly that create the one or more fluid paths that direct water from the propulsion system onto a top surface of the at least one heat exchanger.

68. A ride plate for mounting to the bottom hull portion of a watercraft over a tunnel that houses the watercraft propulsion system, wherein the watercraft includes a power source that is connected to the propulsion system and has a coolant circulating system, the ride plate comprising:

a heat exchanger body having a fluid path defined therein with an inlet port and an outlet port for connection to the coolant circulating system of the power source, the heat exchanger body including a heat exchanging exterior surface adjacent the fluid path for absorbing heat from fluid in the coolant circulating system, the heat exchanger body also including a peripheral edge with fastening formations for connection to the bottom hull portion of the watercraft, wherein the heat exchanger body is formed at least partially from a heat conductive material, wherein the heat exchanging body is a unitary rigid plate sized for spanning an entire width of the tunnel of the watercraft.

69. The ride plate of claim 68, wherein the heat exchanging exterior surface is a plate-like skimming surface for facilitating skimming of the watercraft over water at high speeds.

70. The ride plate of claim 68, wherein the fastening formations include a plurality of apertures, and further comprising threaded fasteners retained in the apertures.

71. The ride plate of claim 68, wherein the heat exchanger body comprises a top plate and a bottom plate secured together and defining the fluid path therebetween.

72. The ride plate of claim 68, wherein the fluid path has a serpentine configuration with a plurality of U-shaped bends.

73. The ride plate of claim 68, wherein the fluid path has a spiraled configuration.

74. A heat exchanger according to claim 68, in combination with a watercraft having a hull, an engine and a propulsion system, wherein said heat exchanger body is cooperable with said hull to define an impeller tunnel having a rearward discharge opening at the stern and a forward intake opening spaced forwardly of said rearward discharge opening, said propulsion system including an impeller assembly secured to said hull within said impeller tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft.

75. A heat exchanger according to claim 74, wherein the heat exchanger body is mounted to said hull such that said exterior surface of said heat exchanger body is flush with portions of said exterior surface of said hull immediately adjacent thereto.

76. A watercraft comprising:

a hull having a tunnel defined by a cavity formed therein, the tunnel having a width that is transverse to a centerline of the watercraft;

an engine disposed within the hull;

a propulsion system positioned at least in part within the tunnel and operatively connected to the engine;

a circulating system including a heat exchanger forming a ride plate extending across the width of the tunnel.

77. A watercraft according to claim 76, wherein said tunnel has a rearward discharge opening at the stern and a forward intake opening spaced forwardly of said discharge opening, said propulsion system including an impeller assembly secured to said hull within said tunnel, said impeller assembly having an impeller with a plurality of blades, said impeller being connected to said engine so as to rotate under power from said engine such that said impeller draws water into said tunnel through said intake port and discharges the drawn water out from said tunnel through said discharge port in a pressurized stream to propel said watercraft.

78. A watercraft according to claim 77, wherein said ride plate comprises a base portion providing an open partial fluid path and a cover portion coupled to said base portion so as to close said open partial fluid path to form a portion of said circulating system.

79. A watercraft according to claim 76, wherein said ride plate is formed of heat conductive material.

80. A watercraft according to claim 79, wherein said heat conductive material is metal.

81. A watercraft according to claim 80, wherein said metal is aluminum.

82. A watercraft according to claim 76, wherein said watercraft is a personal watercraft.

83. A watercraft according to claim 76, wherein said water-craft is a sport boat.

84. A watercraft according to claim 76, wherein said engine is an internal combustion engine.

85. A watercraft according to claim 84, wherein said internal combustion engine is a four-stroke engine.

86. A watercraft according to claim 85, wherein said internal combustion engine is a two-stroke engine.

87. A watercraft according to claim 76, further comprising coolant carried in said circulating system.

88. A watercraft according to claim 87, wherein said coolant comprises glycol.

89. A watercraft according to claim 88, wherein said coolant further comprises water mixed together with said glycol.

90. A watercraft according to claim 76, wherein the heat exchanger includes a body mounted to said hull such that an exterior surface of said heat exchanger body is flush with portions of an exterior surface of said hull immediately adjacent thereto.

91. A watercraft according to claim 76, wherein said ride plate has a coolant fluid path with a serpentine configuration comprising a series of adjacent straight paths including a first straight path, and second straight path, and one or more intermediate straight paths, said first straight path communicating with an inlet port on one end and one of said one or more intermediate straight paths on an opposite end thereof, said second straight path communicating with one end of an outlet port and one of said one or more intermediate straight paths on an opposite end thereof, each of said one or more intermediate paths being connected at each end to one of said first and second straight paths and one of said one or more intermediate paths.

92. A watercraft according to claim 76, wherein said ride plate has a coolant fluid path with a spiraled configuration comprising an inwardly spiraled fluid path and a outwardly spiraled fluid path, said fluid paths communicated at innermost ends to each other proximate a center of said heat exchanger, said inwardly spiraled fluid path communicated at an outermost end to an inlet port and said outwardly spiraled fluid path communicated at an outermost end to an outlet port, one of said inwardly spiraled fluid path and said outwardly spiraled fluid path being nested within the other of said inwardly spiraled fluid path and said outwardly spiraled fluid path.

93. A watercraft according to claim 76, wherein the ride plate includes a two-piece member having the coolant fluid path defined therebetween, with each piece extending the full width of the tunnel.

94. A watercraft according to claim 76, further comprising fasteners that connect the ride plate to the hull, wherein the fasteners extend through the ride plate and the hull such that the ride plate overlaps the exterior surface of the hull.

95. A watercraft according to claim 76, wherein the ride plate includes a partial intake opening that cooperates with an intake opening in the hull to the tunnel to allow water to be drawn into the propulsion system.

96. A watercraft according to claim 95, wherein the partial intake opening is defined by an edge of the ride plate.

97. A watercraft according to claim 76, wherein the ride plate has a lower solid plate-like surface of the heat conductive material.

98. A watercraft according to claim 76, wherein the circulating system is a closed loop system.

99. A watercraft according to claim 76, wherein said ride plate has a lower surface that is a plate-like skimming surface for facilitating skimming of the watercraft over water at high speeds.

100. A watercraft according to claim 76, wherein the circulating system includes a primary fluid path and a secondary fluid path.

101. A ride plate suitable for mounting to a bottom hull portion of a watercraft over a tunnel formed in the bottom hull portion, the watercraft including a power source having a circulating system, the ride plate comprising:

a heat exchanging body being a rigid plate having a fluid path defined therein;

the fluid path being adapted to be in fluid communication with the circulating system of the watercraft when the ride plate is mounted thereto; and the ride plate being sized to extend across an entire width of the tunnel.

102. A ride plate according to claim 101, wherein said heat exchanging body comprises a base portion providing an open partial fluid path and a cover portion coupled to said base portion so as to define said fluid path.

103. A ride plate according to claim 101, wherein said heat exchanging body is formed of heat conductive material.

104. A ride plate according to claim 103, wherein said heat conductive material is metal.

105. A ride plate according to claim 104, wherein said metal is aluminum.

106. A ride plate according to claim 101, in combination with a personal watercraft.

107. A ride plate according to claim 101, in combination with a sport boat.

108. A ride plate according to claim 101, wherein said fluid path has a serpentine configuration comprising a series of adjacent straight paths including a first straight path, and second straight path, and one or more intermediate straight paths, said first straight path communicating with an inlet port on one end and one of said one or more intermediate straight paths on an opposite end thereof, said second straight path communicating with one end of an outlet port and one of said one or more intermediate straight paths on an opposite end thereof, each of said one or more intermediate paths being connected at each end to one of said first and second straight paths and one of said one or more intermediate paths.

109. A ride plate according to claim 101, wherein said fluid path has a spiraled configuration comprising an inwardly spiraled fluid path and a outwardly spiraled fluid path, said fluid paths communicated at innermost ends to each other proximate a center of said heat exchanger, said inwardly spiraled fluid path communicated at an outermost end to an inlet port and said outwardly spiraled fluid path communicated at an outermost end to an outlet port, one of said inwardly spiraled fluid path and said outwardly spiraled fluid path being nested within the other of said inwardly spiraled fluid path and said outwardly spiraled fluid path.

* * * * *

UNITED STATES PATENT AND TRADEMARK OFFICE

CERTIFICATE OF CORRECTION

PATENT NO. : 6,544,085 B1
DATED : April 8, 2003
INVENTOR(S) : Menard et al.

It is certified that error appears in the above-identified patent and that said Letters Patent is hereby corrected as shown below:

Column 12,
Line 31, delete “claim” and insert therefore -- claim 1 --.

Signed and Sealed this

Fourteenth Day of October, 2003

JAMES E. ROGAN
*Director of the United States Patent and Trademark Office*